United States Patent [19]

Work

[11] 4,237,590

[45] Dec. 9, 1980

[54] COMBINATION BURIAL VAULT AND CASKET AND FUNERAL AND BURIAL METHOD OR SYSTEM

[75] Inventor: Gerald L. Work, Spokane, Wash.

[73] Assignee: Wilbert, Inc., Forest Park, Ill.

[21] Appl. No.: 82,059

[22] Filed: Oct. 5, 1979

[51] Int. Cl.[3] ..... A61G 17/00

[52] U.S. Cl. ..... 27/35; 27/2; 27/DIG. 1

[58] Field of Search ..... 27/2, 35, DIG. 1, 4–7

[56] References Cited

U.S. PATENT DOCUMENTS

| | | | |
|---|---|---|---|
| 1,705,410 | 3/1929 | Laidlaw | 27/35 |
| 1,727,242 | 9/1929 | McKee | 27/35 |
| 2,289,406 | 7/1942 | Beranek | 27/35 |
| 2,916,797 | 12/1959 | McCombs | 27/35 |
| 4,139,929 | 2/1979 | Angermann | 27/35 |

*Primary Examiner*—John D. Yasko

*Attorney, Agent, or Firm*—Charles B. Cannon

[57] ABSTRACT

A combination burial vault and casket and funeral and burial method or system using the same in a funeral and burial service. An interiorly decorated "surround" or false casket frame having a hinged top is disposed over the base of the vault and cooperates with the interiorly decorated base of the burial vault to provide a casket during visitation at the funeral home. Carrying handle structures are provided for carrying either the assembled base and the surround or false casket or the assembled base and cover of the vault, with the remains of the deceased therein, to the cemetary after the visitation and funeral services at the funeral home.

In one practice of the invention, when the base and cover of the vault are assembled at the close of services at the funeral home, the surround or false casket with the carrying handle structures thereon is retained at the funeral home for reuse.

In another practice of the invention, the surround or false casket, assembled over and with the base of the vault, with the remains of the deceased therein, is carried to the cemetary, whereupon the surround or false casket with the carrying handle structures thereon, is returned to the funeral home for reuse.

The assembled base and cover of the vault are hermetically sealed prior to interment of the vault and generally U-shaped resilient clamping and reinforcing members are attached to the sealed mating marginal or peripheral sealing flanges of the assembled vault prior to interment.

29 Claims, 27 Drawing Figures

43
44
74
63
27
73
25
75
45
48
43
46
47
42
26
71
52
53
51
72
42
41
43

COMBINATION BURIAL VAULT AND CASKET AND FUNERAL AND BURIAL METHOD OR SYSTEM

BACKGROUND OF THE INVENTION

Attempts have been made heretofore to provide combination burial vaults and caskets and funeral and burial methods or systems which include the reuse of certain components thereof, but such attempts have thus far have had limited, if any, success. Among such other prior attempts has been the use of cardboard boxes and the burial apparatus and methods or systems disclosed in prior art U.S. Pat. Nos. 1,410,643, 1,883,600, 1,912,790, 2,508,319, 2,848,780, 2,882,584, 2,916,797, 3,127,183 and 3,844,003. However, the combination burial vaults and caskets and funeral and burial vault methods or systems employing the same in the prior art, including those disclosed in the above-mentioned patents, have met with limited, if any, success, due to many causes, including impracticality, cost, lack of proper aesthetic appearance and appeal, inability to conform to the traditional dignity of the funeral service at the funeral home and at the cemetery, and for other reasons.

OBJECTS OF THE INVENTION

An object of the present invention is: (1) to provide a novel combination burial vault and casket and funeral and burial vault method or system employing the same which has the following advantages and characteristics, namely, (a) retains the traditional dignity and aesthetic appeal of the funeral service during visitation and the funeral service at the funeral home and at the cemetery; (2) provides a combination burial vault and casket and funeral and burial vault method or system employing the same which is novel, practical, relatively inexpensive and in which (a) the base of the burial vault cooperates with a generally rectangular-shaped "surround" or false casket, having an open generally rectangular-shaped frame, to provide a display casket during visitation and the funeral service at the funeral home; (b) in one practice of the invention, after the visitation and funeral service at the funeral home the surround or false casket is removed from the base of the vault and retained at the funeral home for reuse, whereupon the cover of the vault is then arranged over the base of the vault to enclose the remains of the deceased resting therein, whereupon novel carrying handle structures are then removably mounted on outwardly projecting mating marginal or peripheral sealing flanges on the side walls of the base and cover of the assembled vault for carrying the assembled vault with the remains of the deceased therein to the cemetery for a graveside or other cemetery service, following which the carrying handle structures are removed from the assembled base and cover of the vault, prior to interment, and returned to the funeral home for reuse; (c) the interior of the base of the vault and the interior of the generally rectangular-shaped open frame of the surround or false casket are provided with decorative interior upholstery to simulate a conventional casket in which the remains of the deceased rest during visitation and the funeral service at the funeral home; (d) the base and cover of the vault embody novel mating marginal or peripheral sealing flanges which extend along and project laterally outwardly from the upper marginal or peripheral edge portions of the side and end walls of the base and from the lower marginal of peripheral edge portions of the side and end walls of the cover, and these mating marginal peripheral sealing flanges embody novel sealing constructions for hermetically sealing the base and cover of the vault together prior to interment; (e) resilient U-shaped clamping and reinforcing members are attached to the mating and sealed marginal or peripheral sealing flanges of the base and cover of teh burial vault, after the base and cover of the vault have been hermetically sealed and prior to interment at the cemetery, to improve the sealing construction between the base and cover of the burial vault and to increase its structural strength and resistance to separation of the base and cover of the vault after interment in the grave opening; and (f) in another practice of the invention, after the visitation and the services at the funeral home, the hinged top or closure member of the surround or false casket is closed in assembled position over the base of the vault with the remains of the deceased therein, whereupon the assembly of the surround or false casket, with the carrying handle structures attached thereto, and the base of the vault, are carried to the cemetery for a graveside or other cemetery service, following which the surround or false casket and the carrying handle structures attached thereto are removed from the base of the vault and returned to the funeral home for reuse. In this practice of the invention, the cover of the vault, which has been separately transported from the funeral home to the cemetery, is then placed over the base of the vault and hermetically sealed thereto prior to interment.

Other objects will appear hereinafter.

DESCRIPTION OF FIGURES IN THE DRAWINGS

FIG. 1 is a perspective view showing the base and cover of the new burial vault assembled and closed and resting upon a supporting base member or platform with one form of the new carrying handle structures attached to the mating marginal or peripheral sealing flanges on the base and cover of the vault after the surround or false casket has been removed from the base of the vault at the funeral home and the assembled vault, with the remains of the deceased therein, is ready for transportation to the cemetery for a graveside or other cemetery service;

FIG. 2 is an exploded perspective view of the base of the new burial vault, the surround or false casket disposed thereabove, prior to assembly at the funeral home, and showing the supporting base member or platform on which the assembly rests during visitation and the funeral service at the funeral home, and illustrating another form of the carrying handle structures attached to the frame of the surround or false casket;

Figure 1:
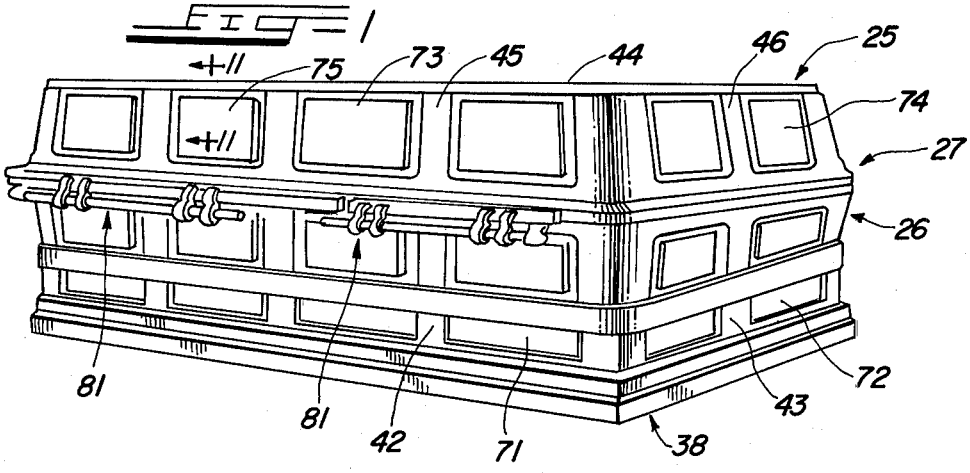
Figure 2:
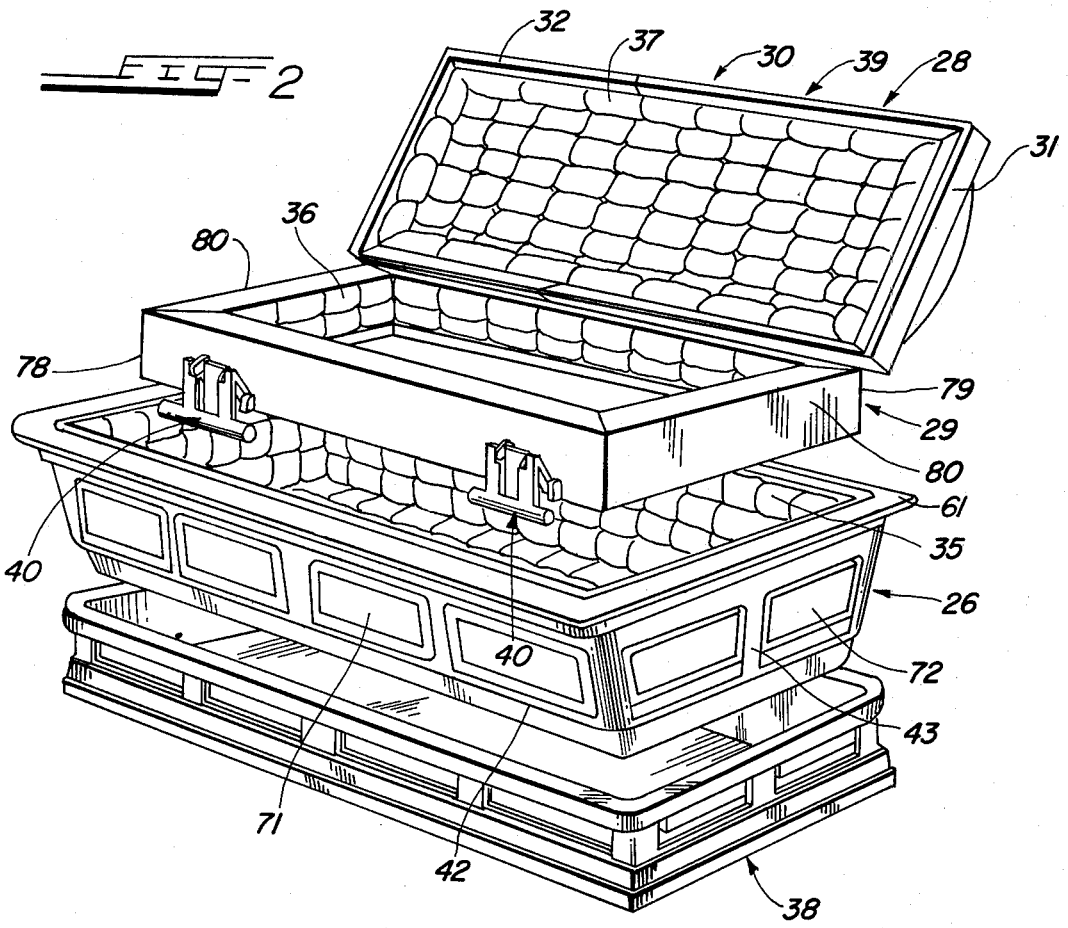
Figure 3:
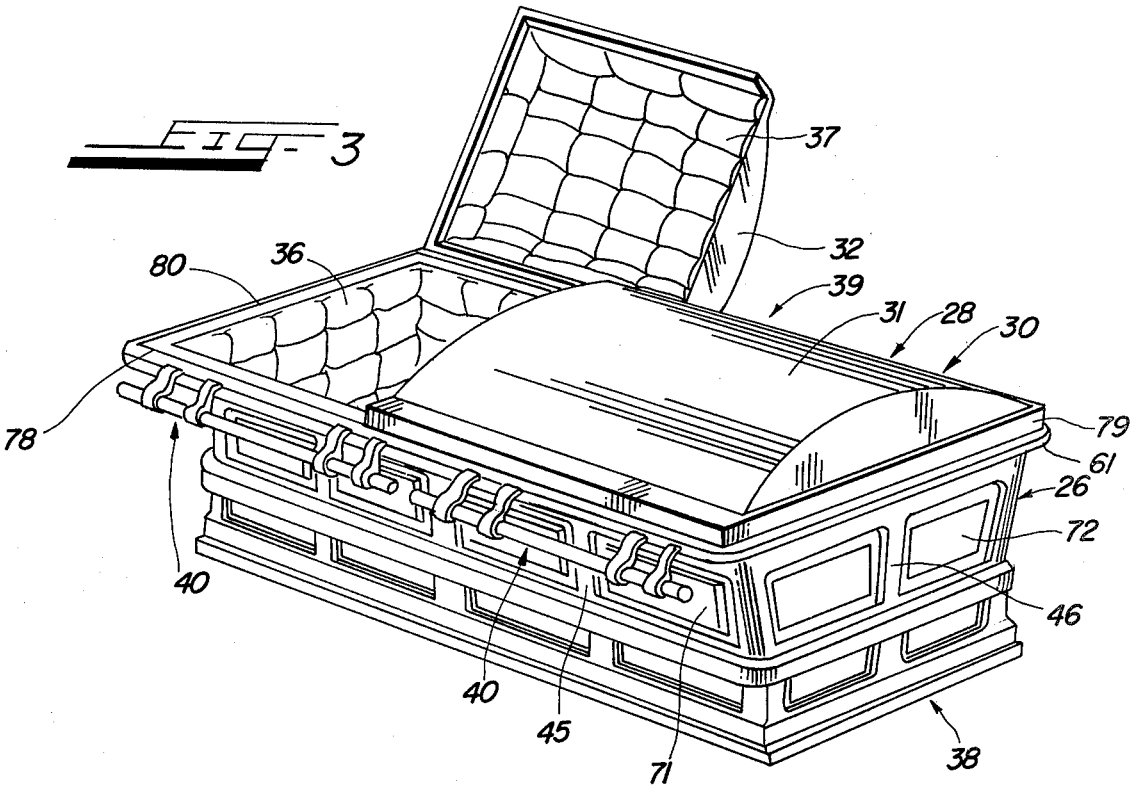
FIG. 3 is a perspective view of the assembled combination of the base of the new burial vault and the surround or false casket with attached carrying handle structures arranged thereon and with the assembly resting upon the supporting base member of platform; the head section of the hinged top or cover of the surround or false casket being shown in open position for visitation at the funeral home.
Figure 4:
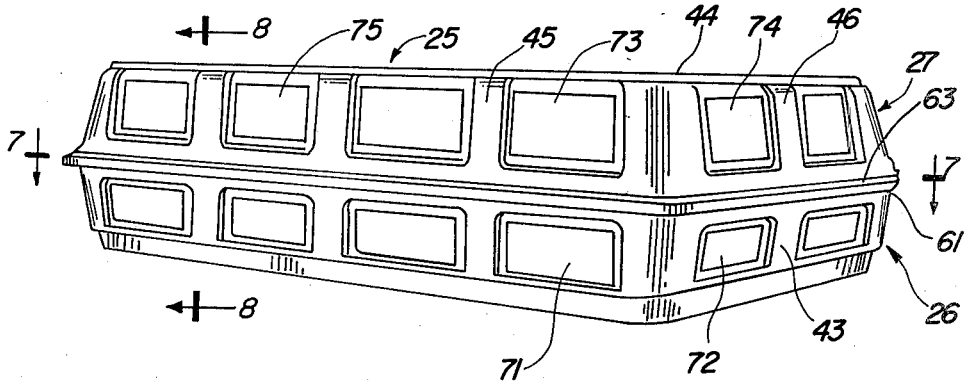
Figure 5:
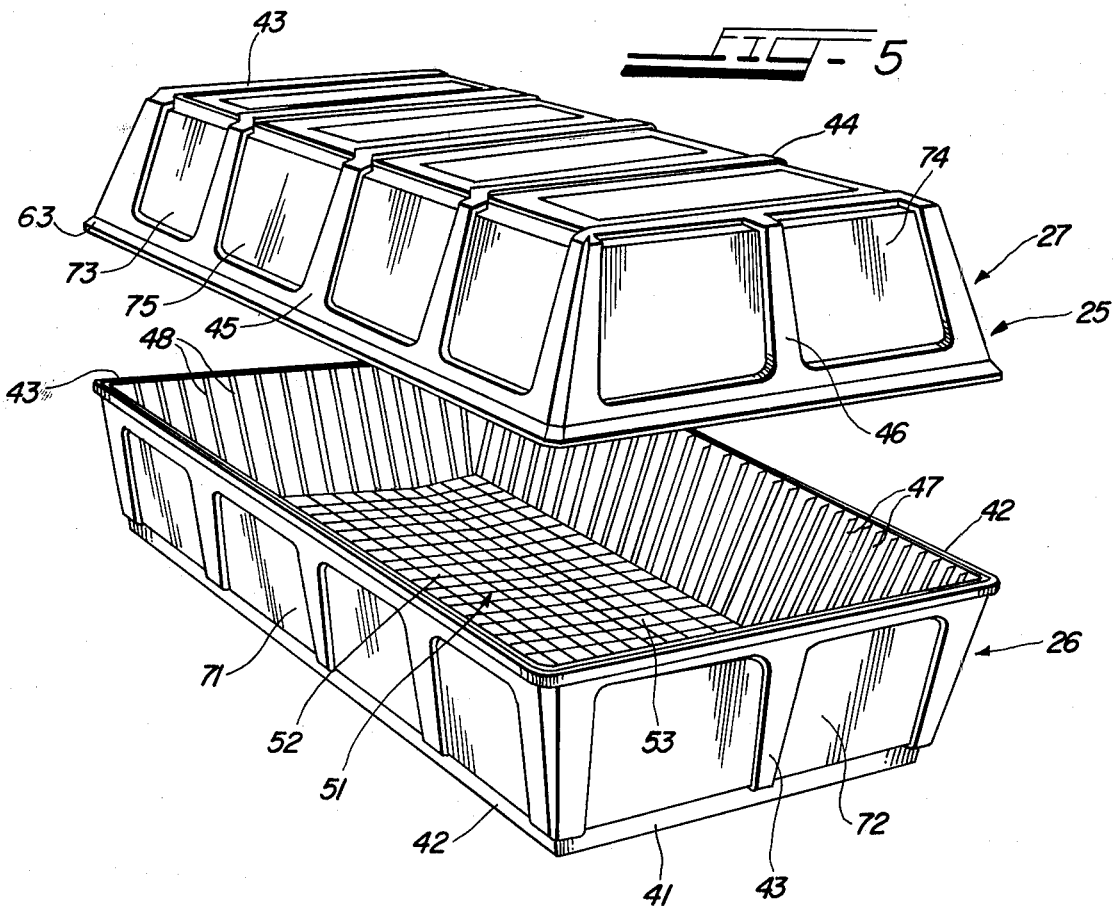
Figure 6:
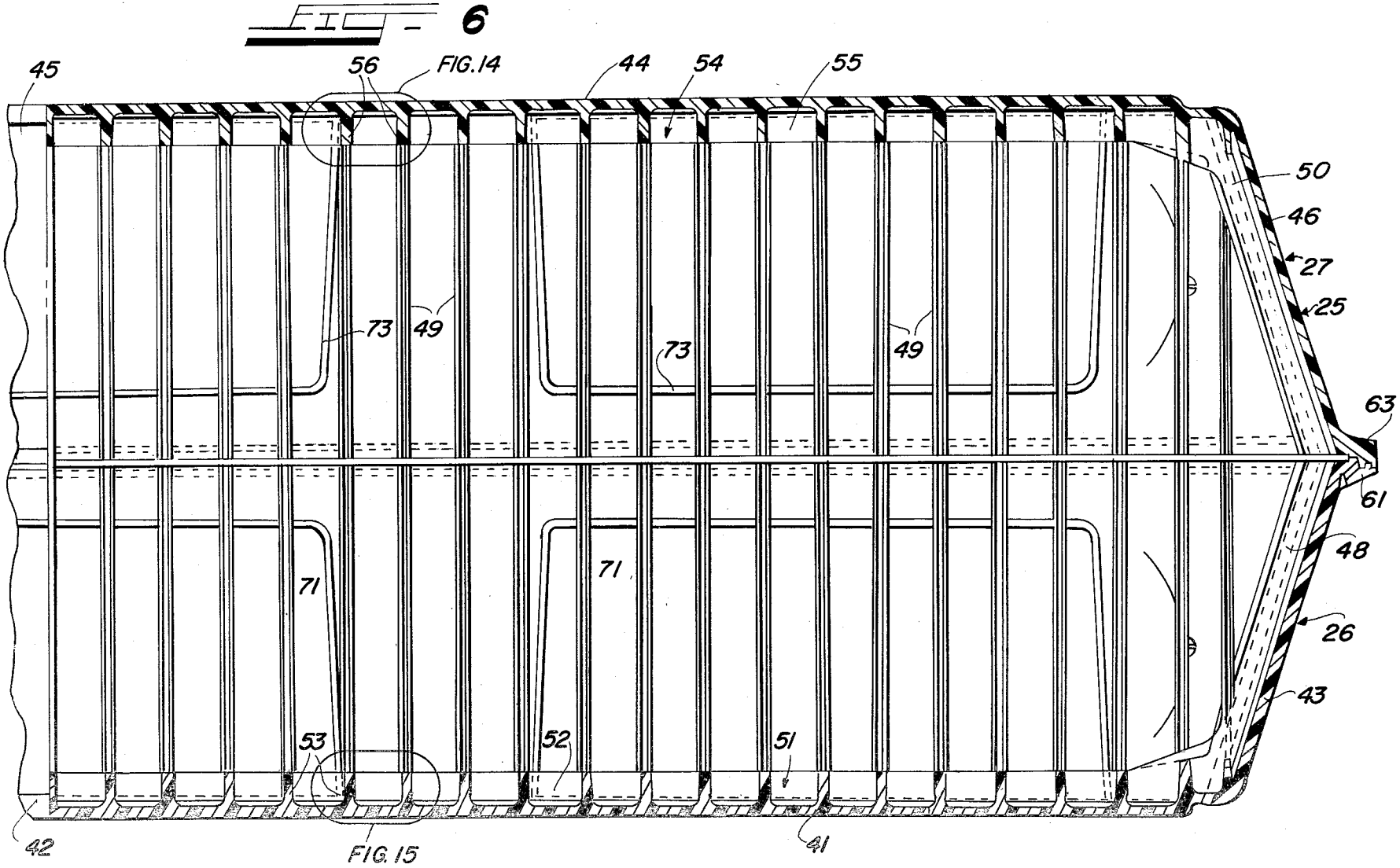
Figure 7:
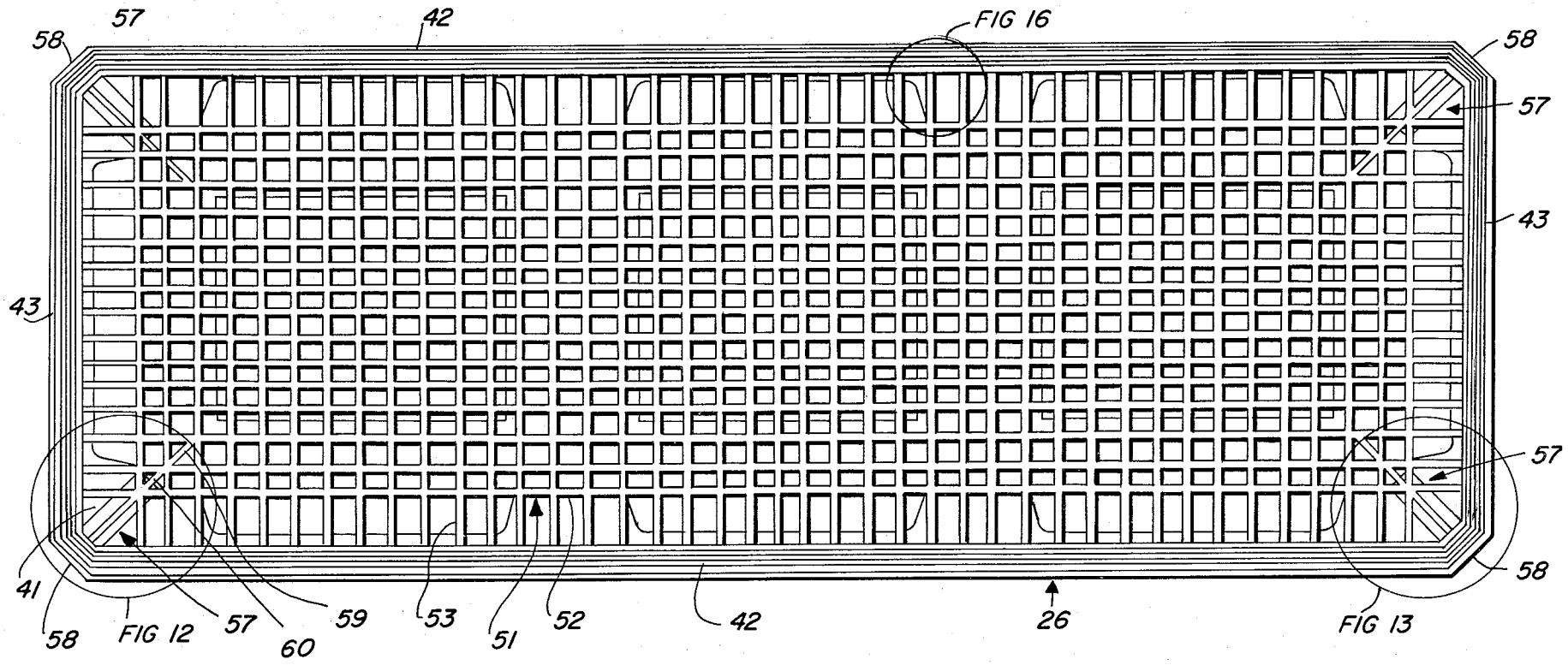
Figure 10:
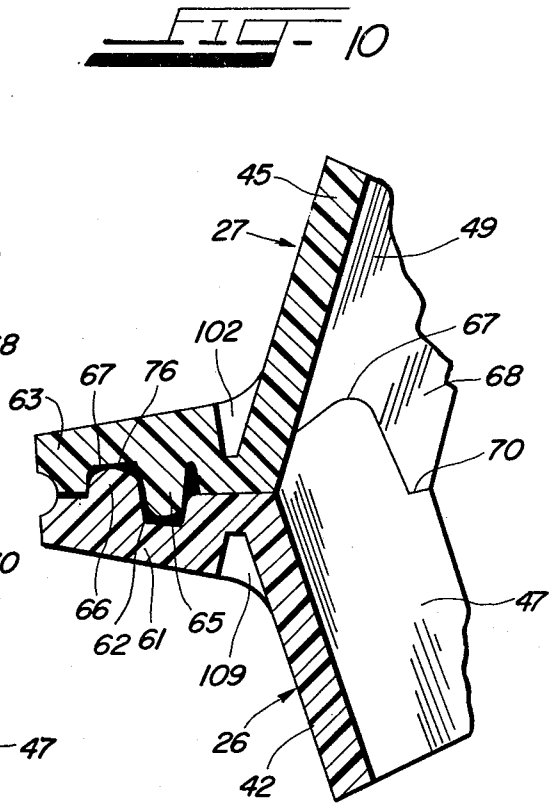
Figure 9:
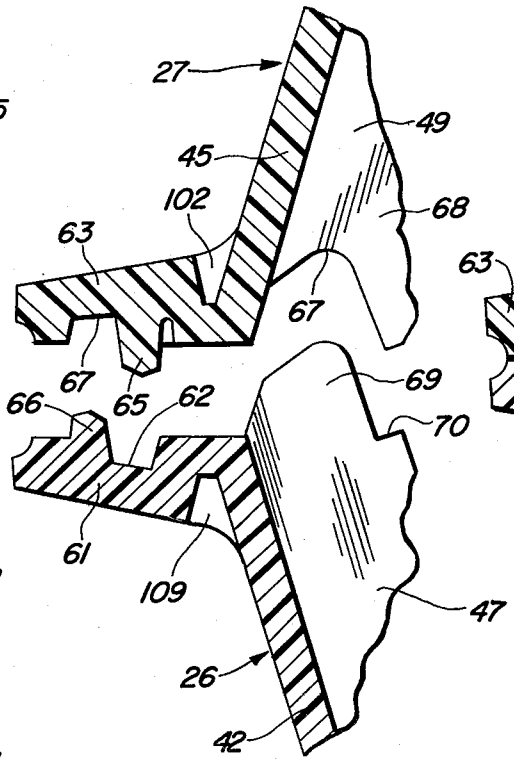
Figure 8:
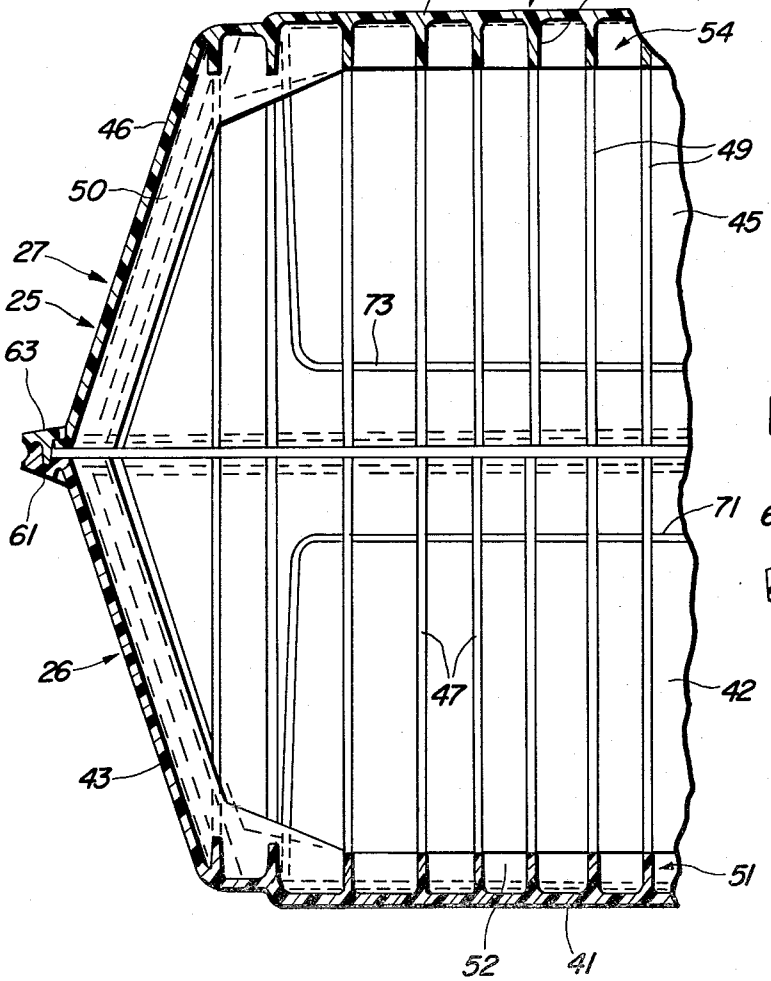
Figure 11:
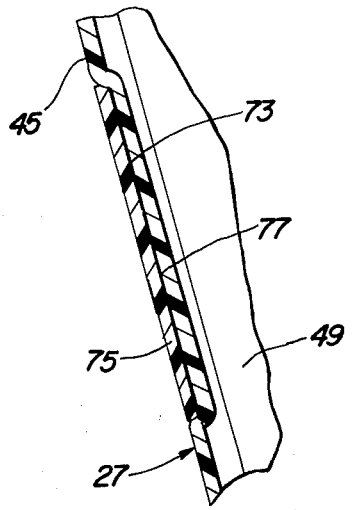
Figure 14:
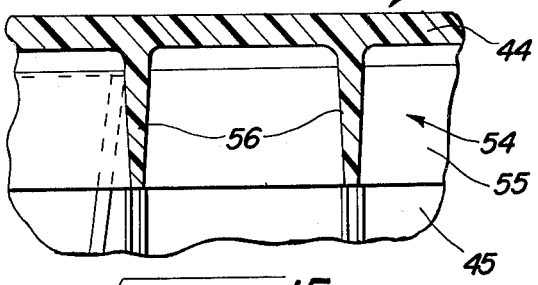
Figure 15:
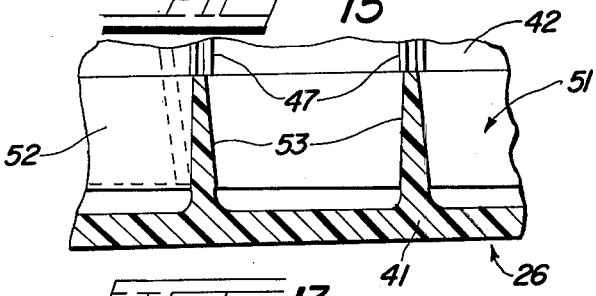
Figure 12:
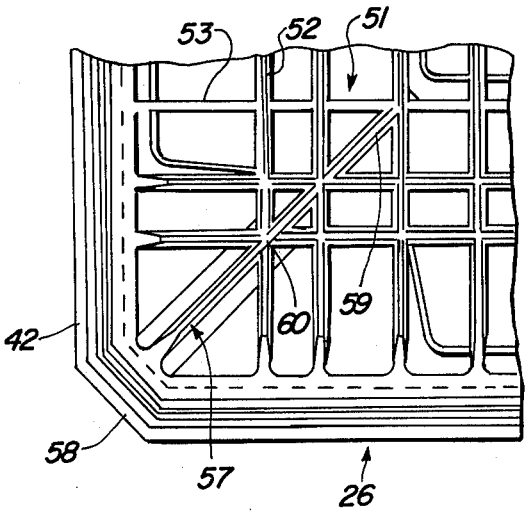
Figure 13:
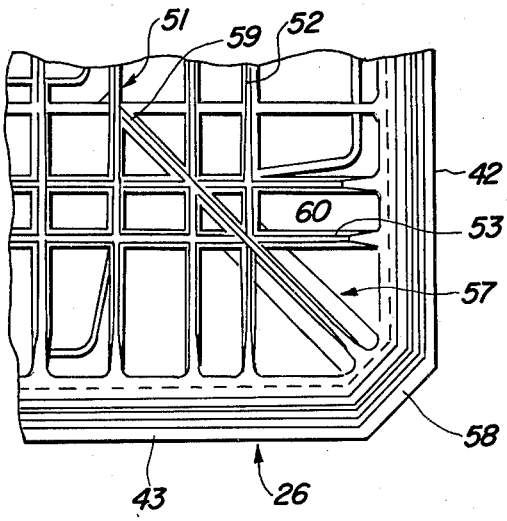
Figure 16:
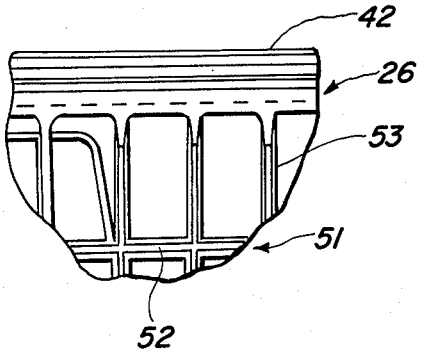
Figure 17:
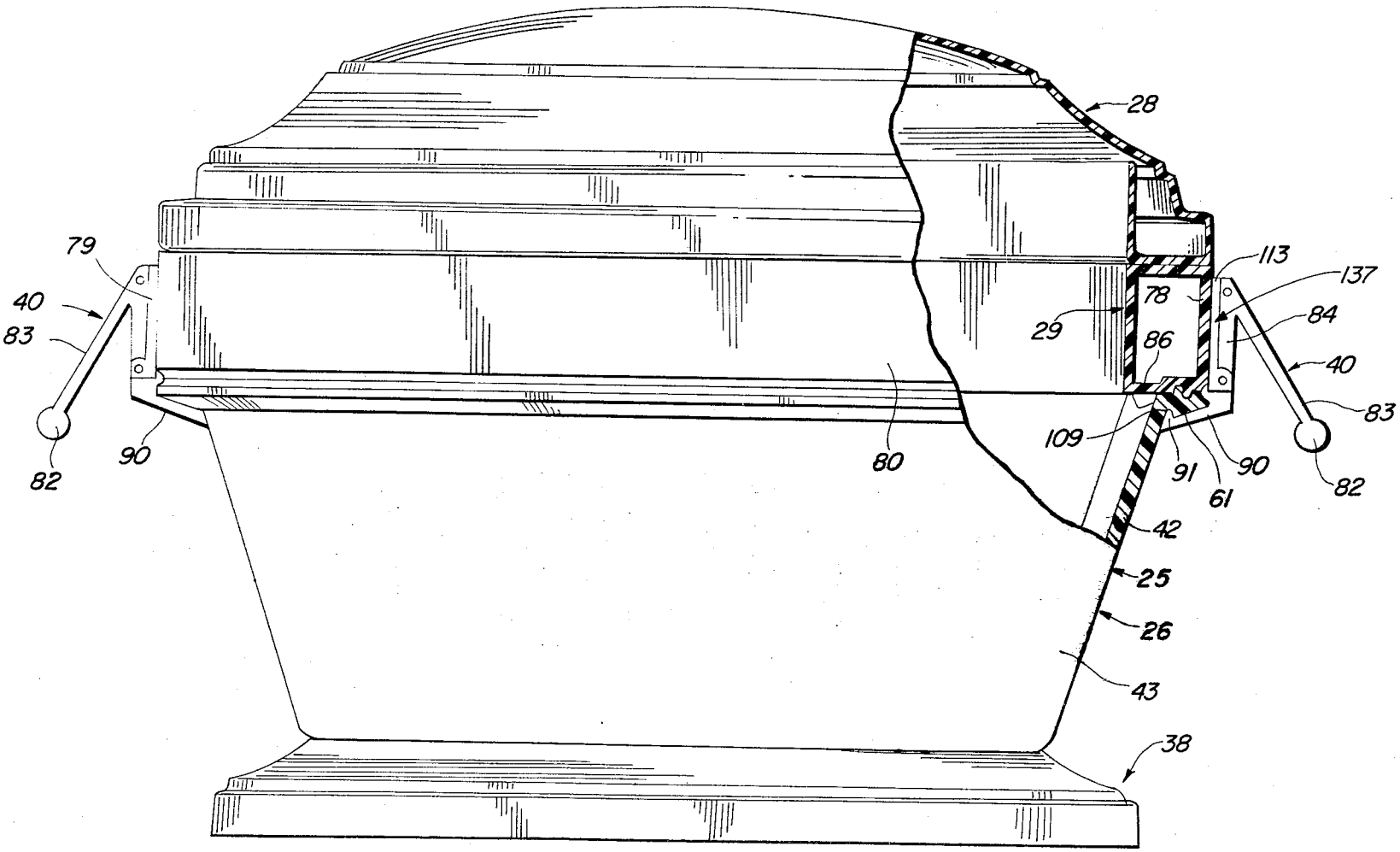
Figure 18:
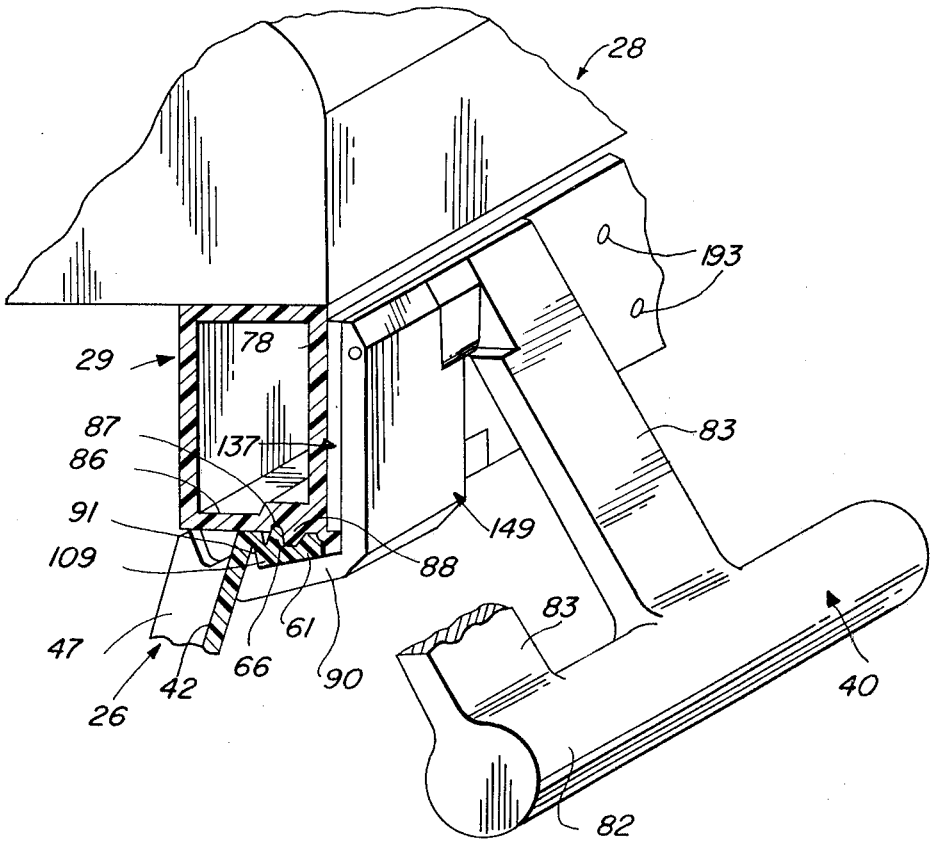
Figure 19:
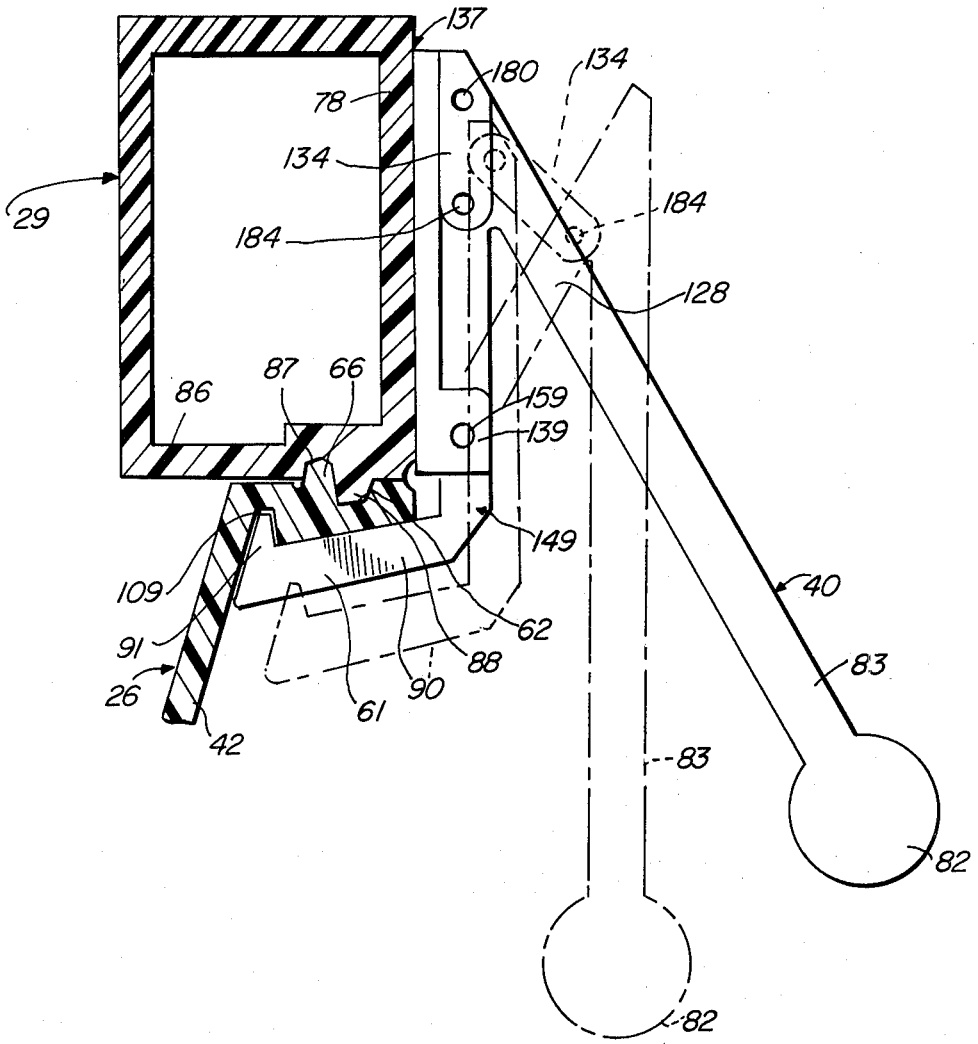
Figure 20:
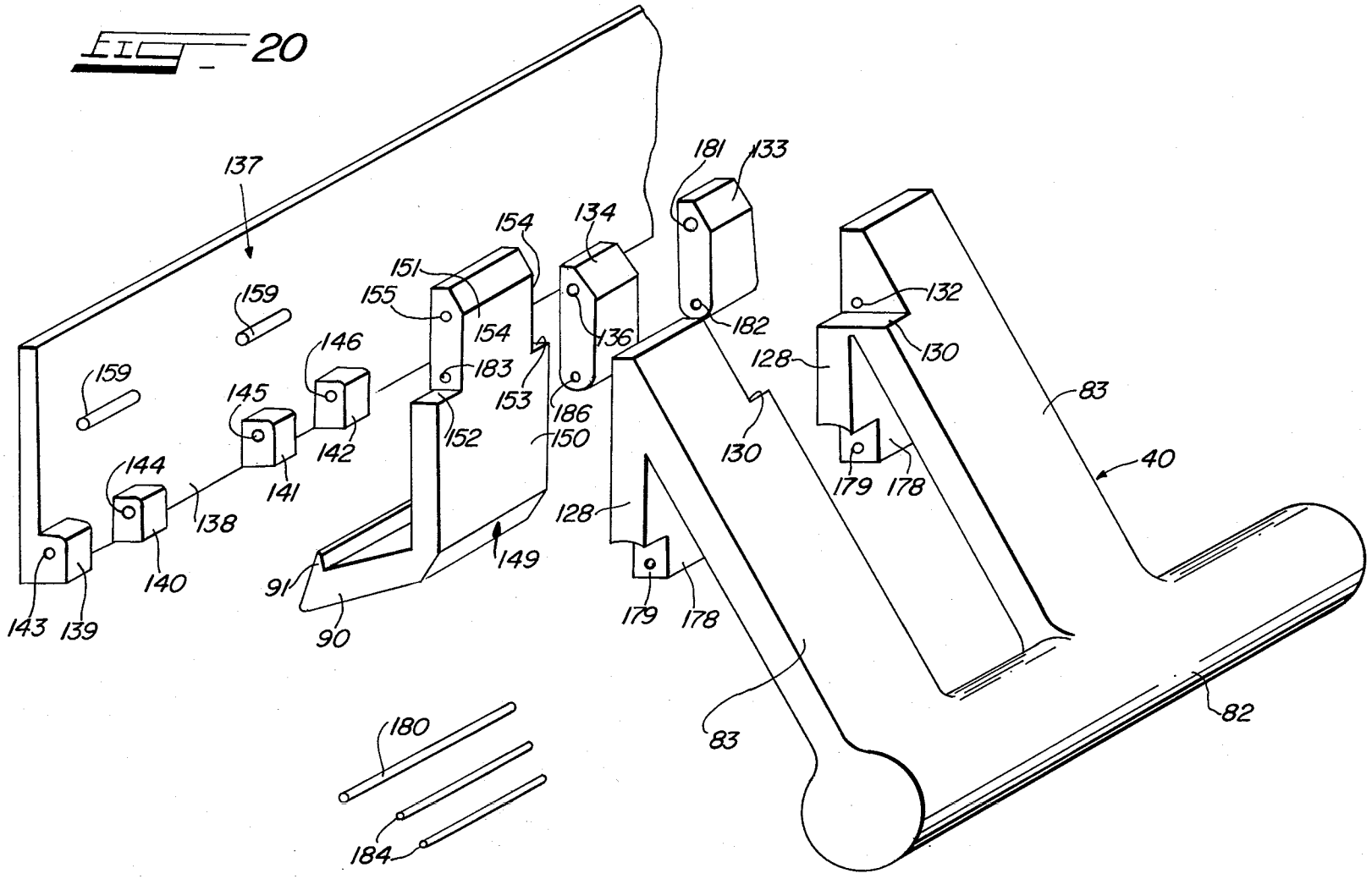
Figure 21:
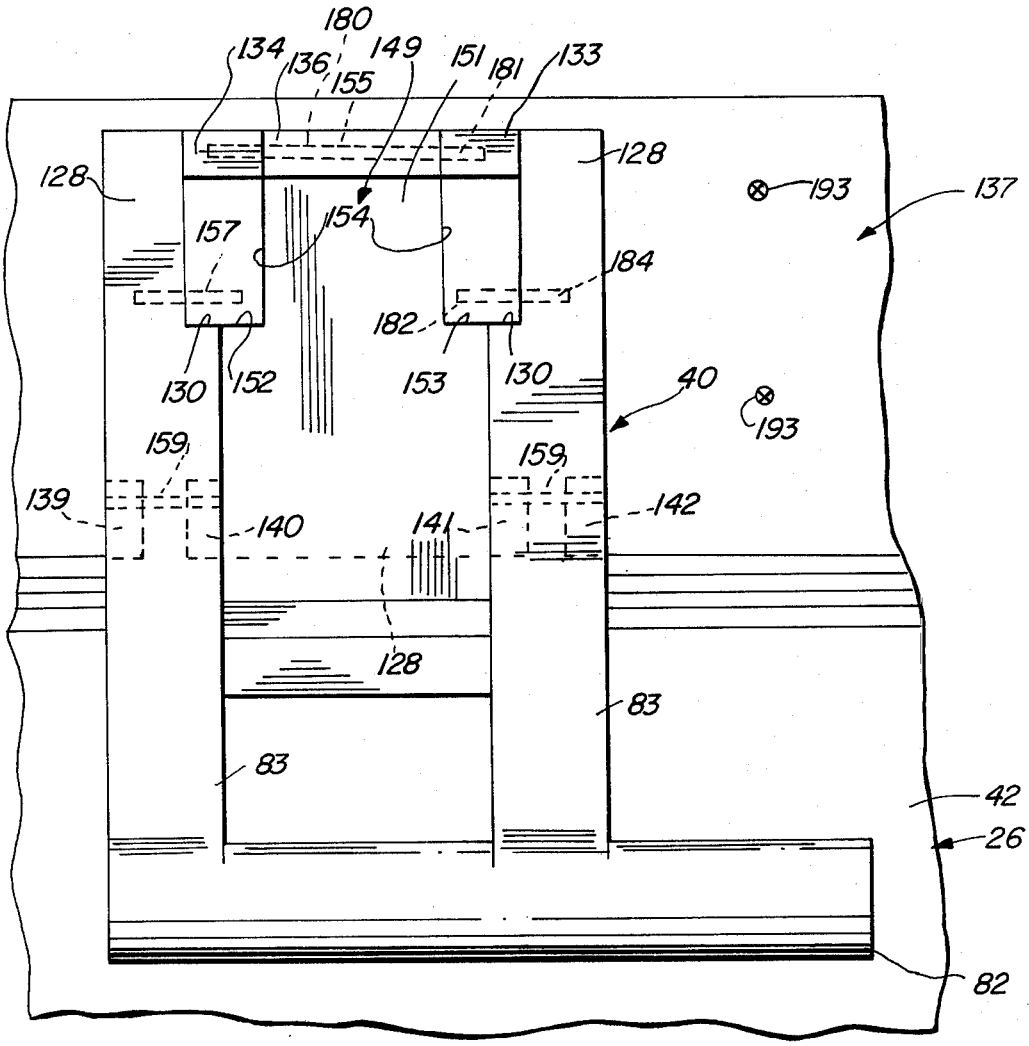
Figure 22:
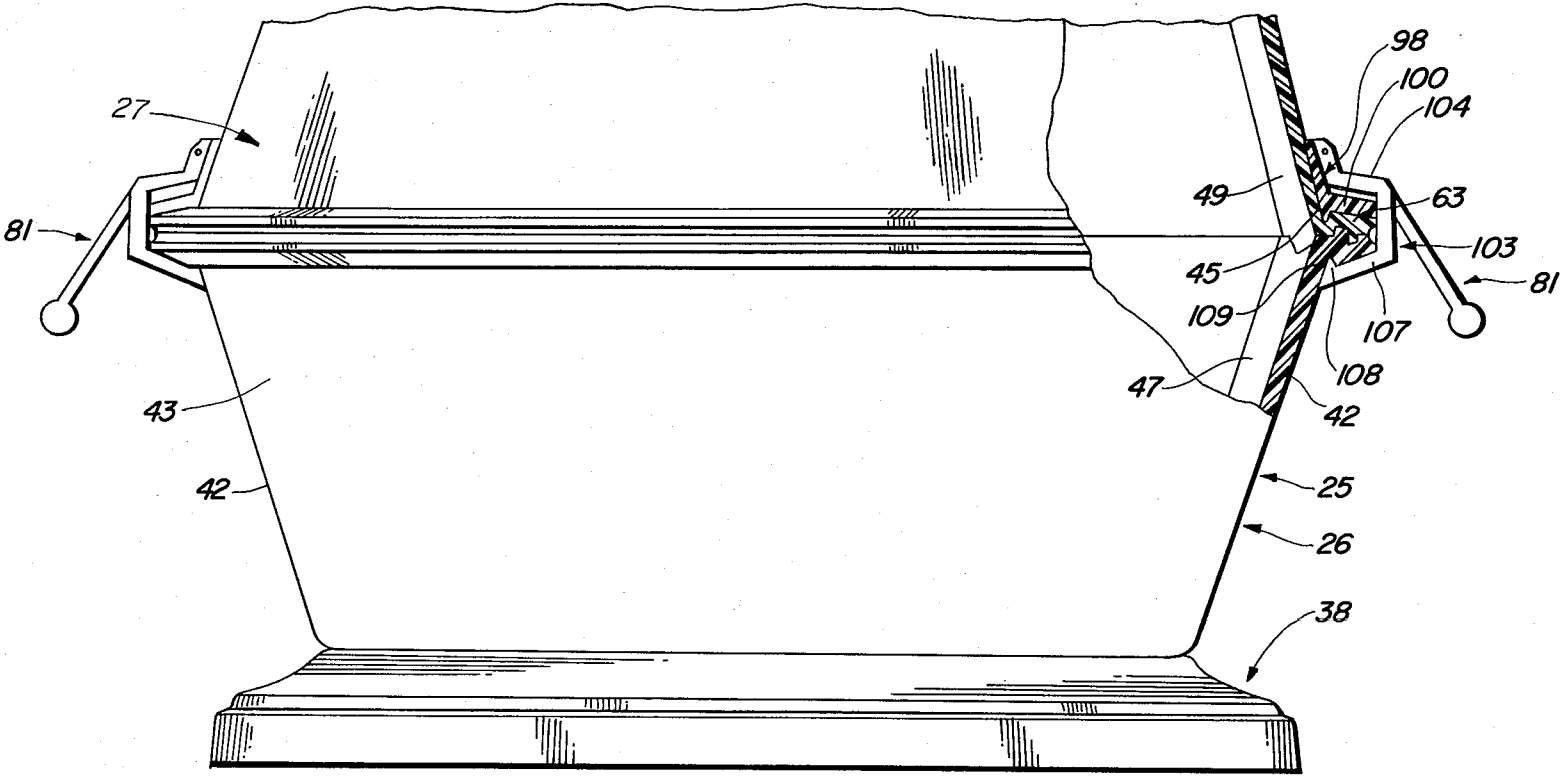
Figure 23:
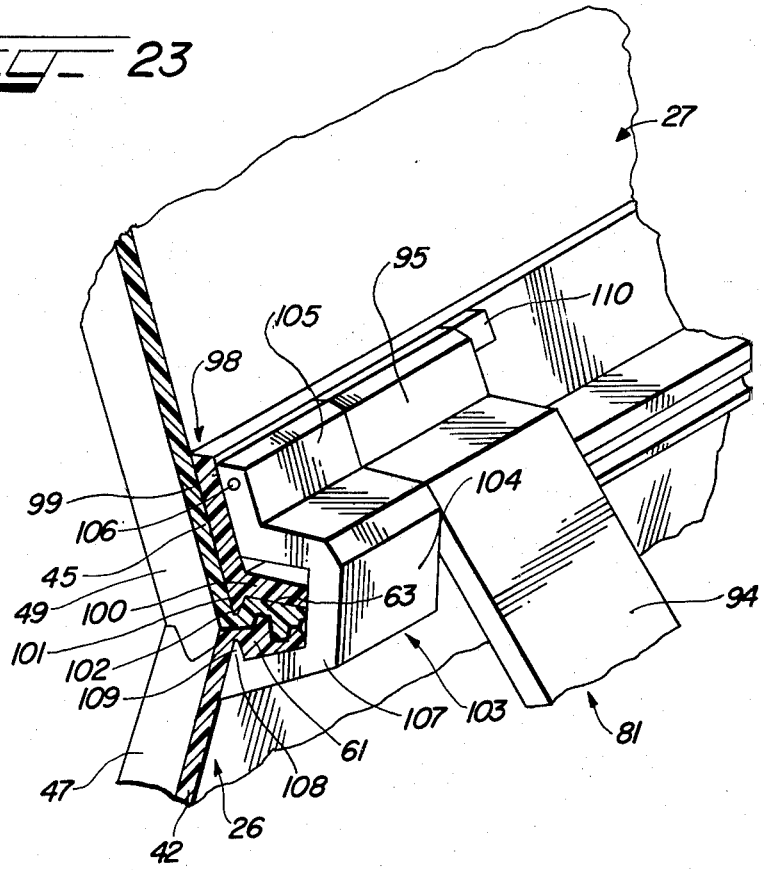
Figure 24:
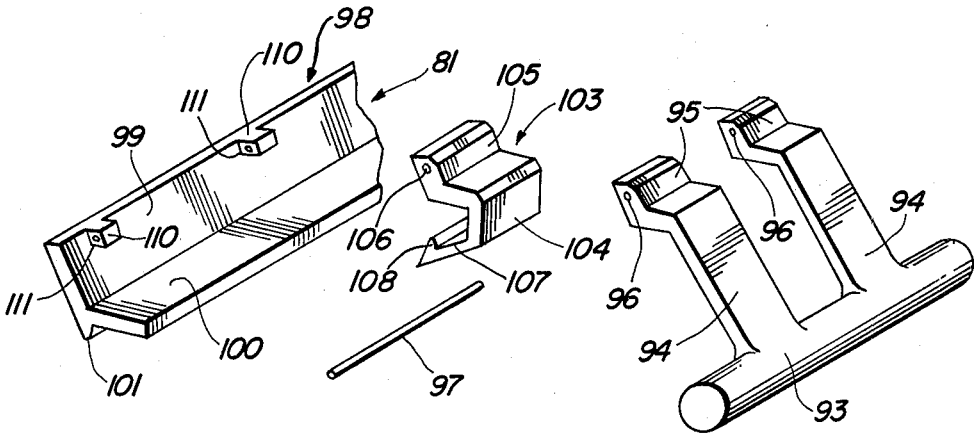
Figure 25:
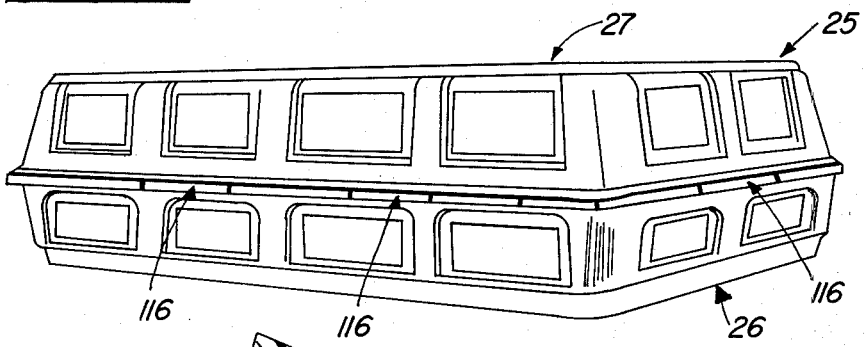
Figure 26:
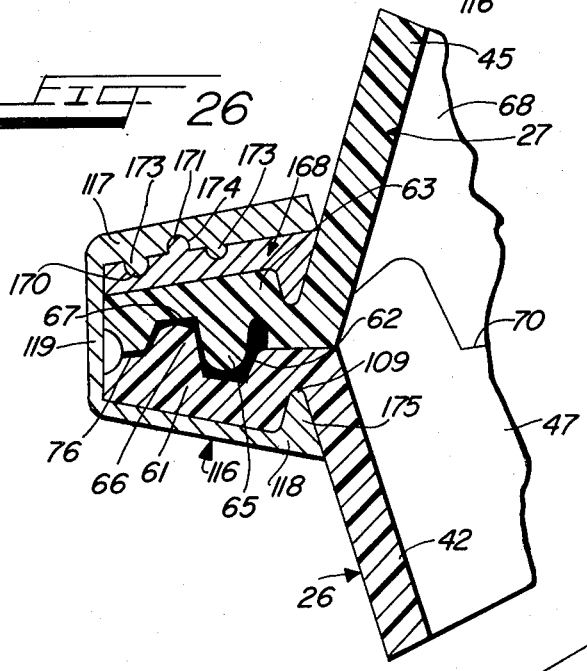
Figure 27:
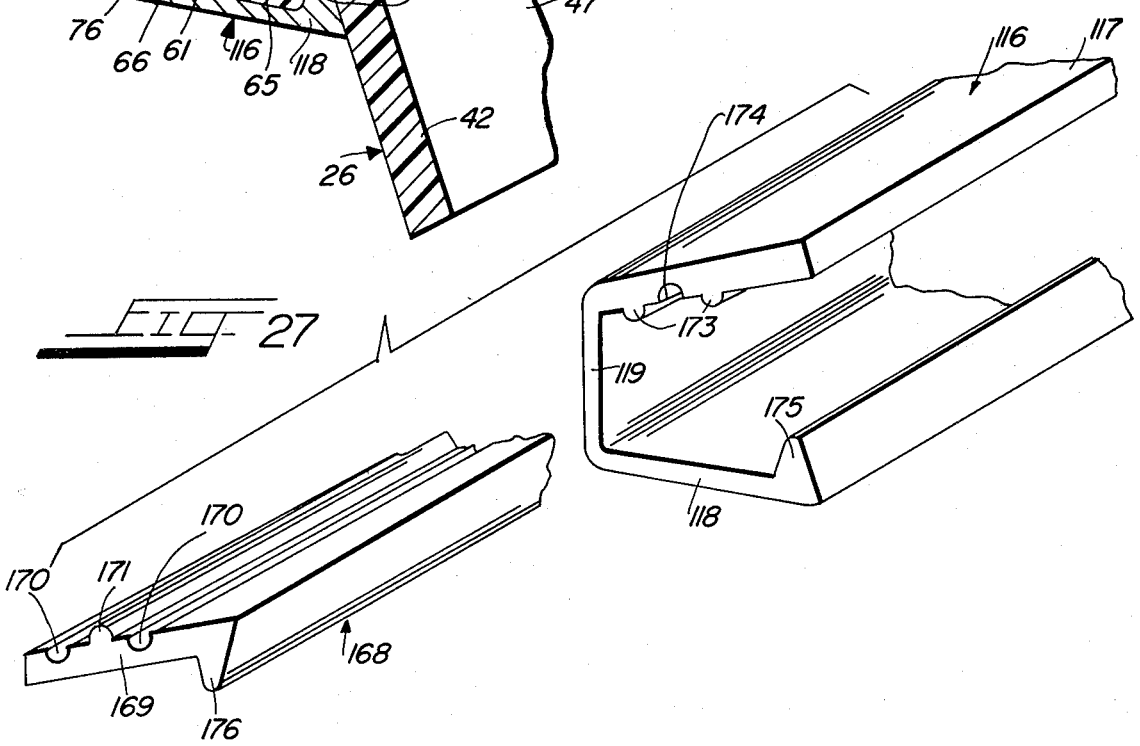

FIG. 4 is a perspective view showing the base and cover of the new burial vault assembled after the visitation and funeral services at the funeral home but prior to attachment of the form of the carrying handle structures shown in FIG. 1 to the mating marginal or peripheral sealing flanges on the side wall of the base and cover of the vault for carrying the assembled vault, with the remains of the deceased therein, to the cemetery for a graveside or other cemetery service;

FIG. 5 is an exploded perspective view of the base and cover of the new burial vault;

FIG. 6 is an enlarged fragmentary vertical longitudinal sectional view of the base and cover of the new burial vault in assembled and sealed position;

FIG. 7 is a horizontal top plan view of the base of the new burial vault, on line 7—7 in FIG. 4;

FIG. 8 is an enlarged fragmentary sectional view of the assembled vault, on line 8—8 in FIG. 4;

FIG. 9 is an enlarged fragmentary exploded sectional view of the sealing construction which is provided by the mating marginal or peripheral sealing flanges on the side walls and end walls of the base and cover of the vault for hermetically sealing the base and the cover of the new burial vault together in assembled position prior to interment;

FIG. 10 is an enlarged fragmentary sectional view of the parts shown in FIG. 8 in assembled and hermetically sealed position;

FIG. 11 is an enlarged fragmentary sectional view, on line 11—11 in FIG. 1, illustrating the mounting of one of the decorative geometrically-shaped panel inserts in one of the correspondingly geometrically-shaped recessed panel areas which are provided in the outer surface of the side walls and end walls of the cover and base of the new burial vault;

FIG. 12 is an enlarged fragmentary top plan view of the area encircled as FIG. 12 in FIG. 7, illustrating one of the reinforcing strut structures which are provided in the corner areas of the base of the new burial vault;

FIG. 13 is an enlarged fragmentary top plan view of the area encircled as FIG. 13 in FIG. 7, illustrating one form of the reinforcing strut structure which is provided in another corner area of the base of the vault;

FIG. 14 is an enlarged fragmentary sectional view of the area encircled as FIG. 14 in FIG. 6, illustrating the construction of the reticulated pattern of reinforcing ribs which is provided on the inner surface of the top wall of the cover of the new burial vault;

FIG. 15 is an enlarged fragmentary sectional view of the area encircled as FIG. 15 in FIG. 6, illustrating the construction of the reticulated pattern of reinforcing ribs which is provided on the upper surface of the base of the new burial vault;

FIG. 16 is an enlarged fragmentary sectional view of the area encircled as FIG. 16 in FIG. 7, illustrating the reticulated pattern of reinforcing ribs which is provided on the inner surfaces of the side walls of the base of the new burial vault;

FIG. 17 is an end elevational view, partly in section, illustrating the base of the new vault, having the surround or false casket mounted thereon, and illustrating the form of the carrying handle structures shown in FIGS. 2 and 3 which are embodied in the invention and which are mounted on the side walls of the generally rectangular-shaped frame of the surround or false casket;

FIG. 18 is a fragmentary perspective view, partly in section, of the carrying handle structure illustrated in FIG. 17;

FIG. 19 is an end elevational view of the carrying handle structure illustrated in FIGS. 2, 3, 17 and 18, attached to the front side wall of the generally rectangular-shaped frame of the surround or false casket; and illustrating the carrying handle structure in latched and carrying position in full lines and in unlatched position in dash lines;

FIG. 20 is an exploded perspective view illustrating the parts of the carrying handle structure illustrated in FIGS. 2, 3, 17, 18 and 19;

FIG. 21 is a front elevational view of the component parts of the carrying handle structure shown in FIG. 20 in assembled position;

FIG. 22 is an end elevational view illustrating the construction of the form of the carrying handle structure illustrated in FIG. 1 and which is embodied in the invention for carrying the assembled base and cover of the vault, with the remains of the deceased enclosed therein, from the funeral home to the cemetery for a graveside or other cemetery service;

FIG. 23 is a fragmentary perspective view, partly in section, of the carrying handle structure illustrated in FIG. 22 as mounted in carrying position on the marginal or peripheral sealing flanges of the side walls of the assembled base and the cover of the vault;

FIG. 24 is an exploded perspective view illustrating the component parts of the carrying handle structure illustrated in FIGS. 1, 17, 22 and 23;

FIG. 25 is a perspective view of the new vault with the base and cover of the vault in assembled and sealed position and showing resilient generally U-shaped clamping and reinforcing members mounted on the sealed mating marginal or peripheral sealing flanges of the vault prior to interment of the assembled and sealed vault;

FIG. 26 is an enlarged fragmentary sectional view illustrating one of the resilient U-shaped clamping and reinforcing members and the retaining means therefor attached to the mating marginal or peripheral sealing flanges of the assembled and hermetically sealed base and cover of the burial vault, prior to interment, to strengthen the seal between the base and cover of the burial vault and to increase its structural strength and resistance to separation of the base and cover of the vault in the grave opening; and FIG. 27 is a fragmentary perspective view illustrating the construction of the resilient U-shaped clamping and reinforcing member and the retaining means therefor, as illustrated in FIG. 26.

GENERAL DESCRIPTION OF THE INVENTION AND ITS USE

The burial vault which is embodied in the new combination burial vault and casket and burial vault method or system, is illustrated in the drawings, wherein, it is generally indicated at 25, and comprises a base 26 and a cover 27, both of which, in a preferred embodiment of the invention, are preferably molded of suitable plastic resinous molding material such, for example, as polystyrene, or the like.

The burial vault 25 embodies the construction which forms the subject matter of and is disclosed and claimed in applicant's copending application, Ser. No. 047,983, filed June 13, 1979 and entitled "Burial Vaults", and which will be described in detail hereinafter.

Figure 3A:
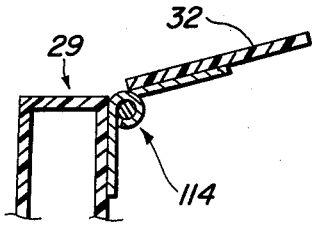
FIG. 3A is a fragmentary elevational view illustrating the hinged connection between the hinged top or cover and the generally rectangular-shaped open frame of the surround or false casket.

The new combination burial vault and casket, as used in the funeral and burial vault method or system, is generally indicated at 39, in FIGS. 2 and 3, and includes as components thereof the base 26 of the burial vault 25 and a so-called "surround" or false casket 28 which includes a generally rectangular-shaped and channel-shaped open frame 29, which may be made of any suitable material, such, for example, as suitably colored molded plastic resinous material, wood, or the like, and includes front and rear side walls 78 and 79, respectively, end walls 80, and a closure cover or top 30 which includes a foot section 31 and a top or head section 32, both of which are separately hingedly connected to and mounted on the rear wall 79 of the frame 29 of the surround or false casket 28 by means of conventional hinges 114 (FIG. 3A).

As shown in FIGS. 2, 3, 17, 18, 19, 20 and 21 of the drawings, the generally rectangular-shaped and channel-shaped open frame 29 of the surround or false casket 28 has carrying handle structures, generally indicated at 40, mounted on the front and rear side walls 78 and 79, respectively, thereof, for carrying the assembled base 26 of the vault 25 and the surround or false casket 28 arranged thereon, with the remains of the deceased therein, to the cemetery for a graveside or other cemetery service, as will be described in detail hereinafter.

As shown in FIGS. 2 and 3 of the drawings, the base 26 of the burial vault 25 has suitably colored decorative upholstery material such, for example, as colored plastic resinous foam 35, or the like, arranged in and draped around the interior surface of the base 26 of the vault 25. Similarly, the open rectangular-shaped and channel-shaped frame 29 of the surround or false casket 28 has suitable colored decorative upholstery material, such as plastic resinous foam 36, or the like, arranged around the inner surfaces of the front and rear side walls 78 and 79, respectively, and the end walls 80 thereof. Likewise, the inner surfaces of the hinged foot section 31 and head section 32, respectively, of the top or cover 30 of the surround or false casket 28 has suitably colored decorative upholstery material, such as plastic resinous foam 37, or the like, arranged within and suitably secured to the inner surfaces thereof.

In the use of the new combination burial vault and casket 39 in the new funeral and burial method or system, the interiorly decorated base 26 of the burial vault 25 is assembled for visitation at the funeral home on a suitable supporting member, such as a supporting base or platform 38, and the generally-rectangular-shaped and channel-shaped open frame 29 of the interiorly decorated surround or false casket 28 is assembled on the base 26 of the burial vault 25, as shown in FIG. 3, and as will be described more fully hereinafter, and with the remains of the deceased resting in the interiorly decorated and upholstered simulated casket 39 which is provided by the combination of the base 26 of the burial vault 25 and the surround or false casket 28. During visitation and other funeral services at the funeral home the hinged foot 31 of the top or cover 30 of the surround or false casket 28 is normally closed and the head section 32 is normally disposed in open position, for viewing, as shown in FIG. 3.

In one practice of the invention, after the visitation and other funeral services at the funeral home, the surround or false casket 28-29 assembled on and with the base 26 of the vault 25, and with the carrying handle structures 40 attached thereto, as shown in FIGS. 3, 17, 18, 19, 20 and 21, as will be described hereinafter, are transported to the cemetery, with the remains of the deceased therein, by means of the carrying handle structures 40.

The surround or false casket 38 and the carrying handle structures 40 attached thereto are then removed from the base 26 of the burial vault 25 and returned to the funeral home for reuse, whereupon the cover 27 of the vault 25 is assembled over the base 26 of the vault 25, at the cemetery, as shown in FIG. 4 of the drawings, and as will be described in detail hereinafter, with the remains of the deceased resting in the interiorly decorated base 26 of the vault 25. The assembled base and cover 27 of the vault 25 and then hermetically sealed together prior to interment, and generally U-shaped resilient clamping and reinforcing members are mounted on the mating and sealed marginal or peripheral sealing flanges of the base and cover of the assembled vault to increase its structural strength and resistance to separation of the base and cover of the vault in the grave opening, as will be described more fully hereinafter.

In another practice of the invention, after the close of visitation and the funeral services at the funeral home, carrying handle structures, generally indicated at 81 (FIGS. 1, 22, 23 and 24), which will be described hereinafter, are removably mounted on the mating marginal or peripheral flanges 61 and 63 of the base and cover 27, respectively, of the vault 25 for carrying the assembled vault 25, with the remains of the deceased therein, to the cemetery for a graveside or other cemetery service, following which the carrying handle structures 81 are removed from the mating marginal or peripheral sealing flanges of the assembled base and cover of the vault and are returned to the funeral home for reuse. The base 26 and cover 27 of the vault 25 are then hermetically sealed at the cemetery prior to interment, if the base 26 and cover of the vault 25 have not previously been hermetically sealed at the funeral home after the visitation and other services at the funeral home.

DETAILED DESCRIPTION OF THE CONSTRUCTION OF THE BURIAL VAULT 25 (FIGS. 5 TO 16, INCLUSIVE)

The construction of the new burial vault 25 is shown in detail in FIGS. 5 to 16, inclusive, of the drawings and, as there shown, the base 26 of the vault 25 includes a bottom wall 41, outwardly and upwardly flared side walls 42 and end walls 43. The cover 27 of the vault 25 includes a top wall 44, outwardly and downwardly flared side walls 45 and outwardly and downwardly flared end walls 46.

The base 26 of the vault 25 has a series of parallel reinforcing spaced ribs 47 which are formed integral with the side walls 42 on the inner surfaces thereof (FIGS. 6 and 15), and each of the end walls 43 of the base 26 has similar parallel spaced reinforcing ribs 48 formed integral therewith on the inner surfaces thereof.

Similarly, the cover 27 of the vault 25 has a series of parallel reinforcing ribs 49 formed integral with and on the inner surfaces of the side walls 45 of the cover 27 and each of the end walls 46 of the cover 27 has a series of parallel reinforcing ribs 50 formed integral therewith on the inner surfaces thereof (FIGS. 6 and 8).

The bottom wall 41 of the base 26 of the vault 25 has a pattern 51 of reticulated reinforcing ribs formed integral therewith on the inner and upper surface of the bottom wall 41 thereof, and this pattern 51 of reticulated reinforcing ribs includes a series of parallel longitudinally extending reinforcing ribs 53 which intersect with and are integrally molded to the longitudinally extending reinforcing ribs 52 (FIGS. 6 and 15).

Similarly, the top wall 44 of the cover 27 has a pattern 54 of reticulated reinforcing ribs formed integrally therewith on the inner and lower surface thereof and this pattern 54 of reinforcing ribs includes a series of parallel longitudinally extending reinforcing ribs 55 and a series of parallel transversely extending reinforcing ribs 56 which intersect with and are integrally molded to the longitudinally extending reinforcing ribs 55.

The bottom wall 41 of the base 26 has a corner reinforcing strut structure 57 at each corner thereof. Each of these corner reinforcing strut structures 57 is molded integrally with the bottom wall 41 of the base 26 and extends diagonally inwardly from the corner, as 58, of the base 26, partially across the inner surface of the bottom wall 41 of the base 26 to a point 59 (FIGS. 7, 12 and 13), where it merges into the reticulated pattern 51 of reinforcing ribs 52 and 53 to which it is integrally molded along its length, as at 60; each of the reinforcing strut structures 57 being somewhat wider near the corners 58 of the base 26 and tapering inwardly toward its end as at 59 (FIGS. 7, 12 and 13).

As is also shown in FIGS. 7, 12 and 13 of the drawings, each of the corner reinforcing strut structures 57 extends rightangularly inwardly from and relative to an angularly extending corner portion 58 of the base 26 of the vault 25, thereby further enhancing the structural strength of the base 26 of the vault 25 at the corners thereof.

Each of the outwardly and upwardly flared side walls 42 and end walls 43 of the base 26 of the vault 25 has an outwardly extending marginal or peripheral sealing flange 61 formed integral therewith at the upper edge thereof and each of these marginal or peripheral sealing flanges 61 has a longitudinally extending sealing groove 62 and a longitudinally extending sealing tongue 66 formed therein on its upper surface (FIGS. 9 and 10).

In addition, each of the marginal or peripheral sealing flanges 61 on the side walls 42 of the base 26 has a longitudinally extending groove 109 formed therein, for a purpose which will be described hereinafter in connection with the description of the construction and use of one form of the carrying handle structures 81 (FIGS. 1, 22, 23 and 24) which are embodied in the invention.

Similarly, each of the side walls 45 and end walls 46 of the cover 27 has an outwardly or laterally extending marginal or peripheral sealing flange 63 formed integral therewith at its lower edge and each of these marginal or peripheral sealing flanges 63 has a longitudinally extending sealing groove 67 formed therein and a longitudinally extending sealing tongue 65 formed on its lower surface (FIGS. 9 and 10).

In addition, each of the marginal or peripheral flanges 63 on the side walls 45 of the cover 27 has a longitudinally extending groove 102 formed therein in its upper surface for a purpose which will be described hereinafter in connection with the description of the construction and use of the carrying handle structures 81 (FIGS. 1, 22, 23 and 24) which are embodied in the invention.

As is readily apparent, the position and arrangement of the mating and coacting sealing grooves 62 and 67 and sealing tongues 65 and 66, as described above, and as shown in FIGS. 9 and 10 of the drawings, may be varied in that the sealing groove 67 and the sealing tongue 65 on the marginal or peripheral flange 63 of the cover 27 may be reversed with the sealing groove 67 arranged inwardly of the sealing tongue 65 on the marginal or peripheral sealing flange 63, rather than outwardly thereof, as shown in the illustrative arrangement illustrated in FIGS. 9 and 10 of the drawings and, similarly, the sealing tongue 66 on the sealing flange 61 of the base 26 may be arranged outwardly of the sealing groove 62, if desired.

It will be noted (FIGS. 9 and 10), that at least certain of the reinforcing ribs 49 on the inner surfaces of the side walls 45 of the cover 27 have a latching groove 67 and a latching tongue 68 formed therein in the lower edge thereof and that a complementary and correspondingly shaped latching tongue 69 and latching groove 70 are formed in the upper edge portion of at least certain of the reinforcing ribs 47 on the inner surfaces of the side walls 42 of the base 26. A similar arrangement of the latching grooves 67–70 and latching tongues 68–69 may be provided on the inner surfaces of the end walls 46 of the cover 27 and on the end walls 43 of the base 26, if desired, and the number of these latching tongues and grooves may be varied, dependent upon the size of the vault and other factors.

Each of the side walls 42 of the base 26 of the vault 25 has a series of spaced geometrically-shaped recesses formed therein, which are shown as being generally rectangular in shape, but may have any desired geometrical shape or form, and each of the end walls 43 of the base 26, has at least a pair of similarly geometrically shaped recesses 72 formed therein. Similarly, each of the side walls 45 of the cover 27 has a series of geometrically-shaped recesses 73 formed therein on the outer surface thereof and each of the end walls 43 of the cover 27 has at least a pair of spaced geometrically-shaped recesses 74 formed therein on the outer surface thereof.

As shown in FIGS. 1 and 11 of the drawings, a colored geometrically-shaped decorative panel or insert 75 may be arranged in each of the correspondingly geometrically-shaped recesses 73 and 74 in the side and end walls 45 and 46, respectively, of the cover 27, and similar colored geometrically-shaped decorative panels or inserts 75 may be arranged in each of the correspondingly geometrically-shaped recesses 71 and 72 which are formed in the side walls 42 and end walls 43 of the base 26. The decorative panels or inserts 75, may be made from any suitable material, such as molded resinous sheet plastic material, sheet metal, resin coated paper, film, or the like.

As shown in FIGS. 1 and 11 of the drawings, each of the colored geometrically-shaped panels or inserts, as 75, may be adhesively mounted in a corresponding one of the geometrically-shaped recesses, as 73, by means of a suitable adhesive 77 (FIG. 11).

During the operation of assembling the base 26 and the cover 27 of the vault 25 in mating relationship, as described above, the latching tongues 69 on the reinforcing ribs 47 on the inner surfaces of the side walls 42 of the base 26 project into the latching grooves 67 which are formed in the reinforcing ribs 49 on the inner surfaces of the side walls 45 of the cover 27 (FIGS. 9 and 10) and the latching tongues 68 on the reinforcing ribs 49 project into the recesses 70 which are formed on the reinforcing ribs 47 on the base 26, thereby securely latching the base 26 and the cover 27 together and enhancing the structural strength of the thus assembled burial vault 25.

In addition, the reticulated pattern 51 of reinforcing ribs 52 and 53 on the upper surface of the bottom wall 41 of the base 26 and the reinforcing ribs 47 and 48 on the inner surfaces of the side walls 42 and end walls 43 of the base 26 enhance the structural strength of the base 26. Similarly, the reticulated pattern 54 of reinforcing ribs 55 and 56 on the inner surface of the top wall 44 of the cover 27 and the reinforcing ribs 49 and 46 on the side walls 45 and end walls 46, respectively, of the cover 27, enhance the structural strength of the cover 27, and all of these reinforcing rib structures cooperate to enhance the structural strength of the assembled vault 25.

Moreover, the diagonally extending reinforcing strut structures 57 at the bottom corners 58 of the base 26 further enhance the structural strength of the base 26 and of the assembled vault 25.

THE CONSTRUCTION OF THE CARRYING HANDLE STRUCTURE 40 ILLUSTRATED IN FIGS. 2, 3, 17, 18, 19, 20 AND 21 OF THE DRAWINGS FOR CARRYING THE ASSEMBLY OF THE SURROUND OR FALSE CASKET AND THE BASE OF THE VAULT

As shown in FIGS. 18 and 19, the bottom wall 86 of the generally rectangular-shaped and channel-shaped frame 29 of the surround or false casket 28 has a longitudinally extending groove 186 formed therein on its upper surface and in the use of the carrying handle structure 40, as illustrated in FIGS. 2, 3, 17 , 18, 19, 20 and 21 of the drawings , the bottom wall 86 of the frame 29 of the surround or false casket 28 rests on the marginal or peripheral sealing flange 61 which is formed on the front side wall 42 of the base 26 of the vault 25. When the parts are so arranged, the longitudinally extending sealing tongue 66 on the sealing flange 61 extends upwardly into the groove 186 in the bottom wall 86 of the channel-shaped frame 29 of the surround or false casket 28 and assists in retaining the surround or false casket 28 and its supporting frame 29 and attached handle structures 40 in position of use.

Similarly, a longitudinally extending latching tongue 88, which is formed on the bottom wall 86 of the frame 29, fits into and extends into the sealing groove 62 which is formed in the sealing flange 61 on the front side wall 42 of the base 26 of the vault 25. This arrangement of the tongue 66 and groove 186 and of the tongue 88 and groove 62 latches the surround 28 and its generally rectangular-shaped and channel-shaped frame 29 to the sealing flange 61 on the side wall 42 of the base 26 to provide an assembly of the surround or false casket 28 and the base 26 of the vault 25 in which the remains of the deceased may be carried to the cemetery for a graveside or other cemetery service.

The construction of a preferred form of carrying handle structure embodied in the invention for carrying the assembly of the surround or false casket 28 and the base 26 of the vault 25 is illustrated in FIGS. 2, 3, 17, 18, 19, 20 and 21 of the drawings, wherein it is generally indicated at 40, and comprises, in general, carrying handle means; a latching hook member which is adapted to engage in a latching groove 109 which is formed in the bottom surface of the sealing flange 61 on the side wall 42 of the base 26 of the vault 25; linkage means for linking the latching hook member to the handle means; and mounting means on which the carrying handle means, the latching hook member, and the linkage means are mounted in position of use on the front wall 78 of the frame 29 of the surround or false casket 28.

Thus, as shown in FIGS. 2, 3, 17, 18, 19 and 21 of the drawings, the handle means which is embodied in the carrying handle structure 40 includes a carrying handle member 82 and a supporting arm structure therefor which includes a pair of laterally spaced and angularly extending supporting arms 83-83, each of which has at its upper end a downwardly angled arm portion 128 which has a reduced lower end portion 178 formed therein and through which a bearing opening 179 extends (FIG. 20). In addition, each of the supporting arms 83 has a notched area formed therein which provides a generally horizontally extending shoulder 130 above which a bearing opening 132 is formed on the upper end portion of each of the supporting arms 83 (FIG. 20).

As stated above, the carrying handle structure 40 includes a latching hook member, which is generally indicated at 149, and includes a main body portion 150 which has a reduced upper end portion 151, thereby providing a pair of laterally spaced horizontally extending shoulders 152 and 153 in the sides of the latching hook member 149, above which is a vertically extending wall 154 is provided, and in which a pair of vertically spaced bearing openings 155 and 183 are provided (FIG. 20). In addition, the latching hook member 149 has an angularly extending arm 90 which projects downwardly from the lower end portion of the body 150 of the latching hook member 149, and, in use, extends inwardly from the main body portion 150 of the latching hook member 149; an upwardly extending latching hook 91 being formed on the inner end portion of the arm 90 (FIG. 20).

As set forth hereinbefore, the carrying handle structure 40 includes linkage means for linking the latching hook member 149 to the handle-supporting arms 83 and this linkage means includes two link members 133 and 134. As shown in FIG. 20, the link member 133 has a pair of, in use, generally vertically spaced bearing openings 181 and 182 formed therein, and, similarly, the link member 134 has a pair of, in use, generally vertically spaced bearing openings 136 and 186 formed therein (FIG. 20). The manner in which the link members 133 and 134 are assembled to link the latching handle member 149 and its supporting arms 83 together for simultaneous operation will be described hereinafter in the description of FIG. 21.

As shown in FIGS. 17 to 21, inclusive, the mounting means for mounting the handle means 83-82, etc., to the latching hook member 149 and the linkage means 133 and 134, etc., in assembled position relative to each other, and in position of use on the front wall 78 of the frame 29 of the surround or false casket 28, is shown in FIGS. 17, 18, 19, 20 and 21 of the drawings and includes a generally rectangular-shaped mounting plate member 137 which may be mounted in any suitable manner, as by fastening means, such as screws 193 (FIGS. 18 and 21), on the front surface of the front wall 78 of the frame 29 of the surround or false casket 28. The mounting plate member 137 has two pairs of bearing bosses 139-140 and 141-142 formed integrally therein and in spaced relationship on its front surface and immediately above the lower marginal edge portion 138 thereof (FIGS. 20 and 21). Each of these bearing bosses 139-140 and 141-142 has a bearing opening 143-144 and 145-146, respectively, formed therein and extending transversely therethrough for the reception of a pivot pin 159 (FIG. 21) by which the reduced lower end portions 178 of the downwardly angled arms 128 of the handle supporting arms 83 are pivotally mounted on the mounting plate member 137.

In the use of the carrying handle structure 40, as illustrated in FIGS. 2, 3, 17, 18, 19, 20 and 21 of the drawings, the component parts thereof, as shown in FIG. 20, are assembled as shown in FIGs. 2, 3, 17, 18, 19 and 21. Thus, as shown in FIG. 21, the latching hook member 149–150–151 is disposed between the handle-supporting arms 83 with the link members 134 and 133 disposed within the notched areas 152–154 and 153–154 (FIG. 20) with the link members 134 and 133 disposed on the horizontally extending shoulders of the latching hook member 149 and with the reduced lower end portions 178 of the downwardly angled portions of the supporting arms 83 disposed between the two pairs of bosses 139–140 and 141–142, as shown in FIG. 21.

When the parts are so disposed, as in FIG. 21, an elongated pivot pin 180 extends through the upper bearing opening 155 in the upper end portion 151 of the latching hook member 149 and into the upper bearing openings 136 and 181 in the link members 134 and 133, respectively. Likewise, when the parts are so arranged, as in FIG. 21, pivot pins 184 extend into the lower bearing openings 186 and 182 in the link members 134 and 133, respectively, and into the bearing openings 132 which are formed in the reduced upper end portions of the supporting arms 83, above the shoulders 130 (FIG. 21).

In the assembly of the parts of the carrying handle structure 40, the reduced lower end portions 178 of the downwardly inclined upper end portions 128 of the supporting arms 83 are inserted between the pairs of bearing bosses 139–140 and 141–142 and pivot pins 159 are inserted through the bearing openings 179 in the reduced lower end portions 178 of the downwardly angled upper end portions of the supporting arms 83 and through the bearing openings 143–144 and 145–146 in the bearing bosses 139–140 and 141–142, respectively.

When the parts of the carrying handle structure 40 are so assembled together, and on the mounting plate member 137, the entire assembly may be mounted in position of use on the outer or front surface of the front wall 74 of the generally rectangular-shaped and channel-shaped frame of the surround or false casket 28, as by means of the fastening screws 193 (FIGS. 18 and 21), with the lower arm 90 of the latching hook member 149 extending under the lower surface of the marginal sealing flange 61 on the side wall 42 of the base 26 of the vault 25, with the parts disposed as in dash lines in FIG. 19, and with the handle-supporting arms 83 extending generally vertically downwardly.

However, when the handle members 82 are manually grasped for the purpose of carrying the assembly of the base of the vault 25 and the surround or false casket 28, with the remains of the deceased therein, from the funeral home to the cemetery, for a graveside or other cemetery service, the supporting arms 83 and the handle member 82 mounted thereon will pivot on the pivot pins 159, in the bearing bosses 139–140 and 141–142, outwardly from dash line to full line position (FIG. 21). This movement of the handle-supporting arms 83 and the handle 82 carried thereby acts through the pivot pins 184 and the link members 134 and 133, to pivot the latching hook member 149 on the upper pivot pin 180 into effective and latching position, that is, from dash line to full line position, FIG. 19, thereby urging the handle-shaped portion 91 on the lower arm 90 of the latching hook member 149 into latching engagement with and in the latching groove 109 which is formed in the lower surface of the sealing flange 61 on the side wall 42 of the base 26 of the vault 25.

In this manner the entire assembly of the mounting plate member 137 and the other component parts of the carrying handle structure 40, as described above, are arranged in assembled position on the generally rectangular-shaped and channel-shaped frame 29 of the surround or false casket 28 for carrying the assembly of the base of the vault 25 and the surround or false casket 28, with the remains of the deceased therein, to the cemetery for a graveside or other cemetery service.

During the carrying operation, as described above, the manual lifting force applied to the handle member 82 and its supporting arms 83 is primarily transmitted against the mounting plate 137 with only a minor part of the force thus applied being applied to the sealing flange 61 on the side wall 42 of the base 26 of the vault 25, and with only a relatively small movement of the handle member 82 and its supporting arms 83 being required to move the parts of the carrying handle structure 40 into effective and latched and carrying position, as in full lines (FIG. 19).

In the preferred form of the carrying handle structure 40, as illustrated in FIGS. 2, 3 and 17 to 21, inclusive, of the drawings, for ease of operation, and for other reasons, as will be pointed out hereinafter, the pivotal connection between the link members 134 and 133, and the latching hook members 149, through the pivot pin 180, is preferably spring-loaded so as to urge the latching hook member 149 away from the handle-supporting arms 83 and the handle 82 mounted thereon and so as to urge the lower arm 90 of the latching hook member 149, and the handle-supporting arms 83 and the handle member 82 thereon, into unlatched position, as shown in dash lines in FIG. 19, and with the hook-shaped portion 91 thereof disposed out of latching engagement with the latching groove 109 which is formed in the bottom surface of the sealing flange 61 on the side wall 42 of the base 26 of the vault 25.

After the assembly of the surround or false casket 28 and the base 26 of the vault 25, with the remains of the deceased therein, have been carried to the cemetery for a graveside, or other cemetery service, the surround 28 and its supporting frame 29 and the attached carrying handle structures 40 mounted thereon, may be removed from the base 26 of the vault 25 and may be returned to the funeral home for reuse. The cover 27 of the vault 25 may then be arranged over and hermetically sealed to the base 26 of the vault 25 prior to interment, as described hereinbefore.

THE CONSTRUCTION AND USE OF THE FORM OF CARRYING HANDLE STRUCTURE 81 ILLUSTRATED IN FIGS. 1, 22, 23 AND 24 OF THE DRAWINGS FOR CARRYING THE ASSEMBLY OF THE BASE 26 AND COVER 27 OF THE VAULT 25

The construction of the form of carrying handle structure 81 which is illustrated in FIGS. 1, 22, 23 and 24 of the drawings, is constructed for use in cases in which it is desired to remove the surround or false casket 28 from the base 26 of the vault 25, after the visitation and close of the funeral service at the funeral home, and to carry the assembled base 26 and cover 27 of the vault 25, with the remains of the deceased therein, to the cemetery for a graveside or other cemetery service, while retaining the false casket at the funeral home for reuse.

Thus, each of the carrying handle structures 81 includes a handle member 83 which is integrally connected to and depends from a pair of supporting arm members 94. Each of the supporting arm members has an offset upper and camming head portion 95 through which a bearing opening 96 extends transversely for the reception of a pivot pin or rod 97 (FIG. 24).

The carrying handle structure 81 embodies a mounting member 98 which includes an upstanding rear wall 99 and an outwardly projecting generally horizontally extending front flange or shelf portion 100. A longitudinally extending latching tongue 101 is formed integrally with and on the lower surface of the mounting member 98 at the intersection between the upstanding rear wall 99 and the front flange or shelf 100 of the mounting plate member 99 and the flange or shelf 100 of the mounting plate member 98 (FIGS. 23 and 24) and in the assembly of the parts, as in FIGS. 22 and 23, the latching tongue 101 fits into a correspondingly shaped latching groove 102 which is formed in the upper surface of the marginal or peripheral sealing flange 63 on the side wall 45 of the cover 27.

Each of the carrying handle structures 81 includes a generally U-shaped clamping member 103 which includes a main body portion 104 having an offset and upwardly extending arm 105 transversely through which a bearing opening 106 extends. The U-shaped clamping member 103 includes a lower clamping flange or arm 107 on the inner end of which an upwardly projecting hook-shaped latching tongue 108 is formed. In the assembly of the parts, as in FIGS. 22 and 23, the hook-shaped latching tongue 108 fits into a correspondingly shaped latching groove 109 which is formed in the lower surface of the marginal or peripheral sealing flange 61 on the side wall 42 of the base 26 of the vault 25.

The upstanding rear wall 99 of the mounting member 98 has a pair of longitudinally spaced bearing bosses 110 formed integrally therewith on its front surface thereof and each of these bearing bosses 110 has a longitudinally extending bearing opening 111 formed therein for the reception of the pivot pin or rod 97.

In the use of the new combination burial vault and casket and funeral and burial method or system employing the carrying handle structures 81, after the visitation and funeral service at the funeral home, the surround or false casket 28 and attached handle structures 40 are removed from the base 26 of the vault 25 and retained at the funeral home for reuse. The cover 27 of the burial vault 25 is then laid over the base 26 with the marginal or peripheral flanges 61 and 63 of the base 26 and cover 27, respectively, arranged in proper mating relationship, as shown in FIGS. 22 and 23, and, if desired, the base 26 and cover 27 may be hermetically sealed together together at the funeral home, with a suitable plastic sealing material 76, as shown in FIG. 10 of the drawings. However, in most cases it is preferred that the hermetic sealing of the base 26 and cover 27 of the vault 25 be done at the cemetery since if the sealing operation is done at the funeral home it may unduly delay the departure of the funeral procession to the cemetary and, moreover, this sealing operation is best done at the cemetary by experts in the employ of the vault manufacturer who has the primary responsibility for the quality of the seal in the vault and for the warranty of the vault thus sealed and made water-resistant.

After the base and cover of the vault 25 have thus been assembled at the funeral home, with the remains of the deceased enclosed therein, the carrying handle structures 81 are removably mounted on and attached to the mating marginal or peripheral flanges 61 and 63, respectively, of the base and cover 27, respectively, of the vault 25 and this is accomplished as follows: The mounting member 98 is positioned, as shown in FIGS. 22 and 23, with the front flange or shelf 100 of the mounting member 98 laid over and resting upon the upper surface of the marginal or peripheral flange 63 of the cover 27 and with the upstanding rear wall 99 of the mounting member 98 resting against the outer or front surface of the side wall 45 of the cover 27 of the vault 25, and with the mating marginal or peripheral sealing flanges 61 and 63 assembled as shown in FIGS. 22 and 23. When the parts are so positioned, the latching tongue 101 on the mounting member 98 fits into the latching groove 102 in the marginal sealing flange 63 of the cover 27 of the vault 25 and thus assists in retaining the mounting member 98 in position of use on the marginal sealing flange 63 of the cover 27 of the vault 25.

The generally U-shaped clamping member 103 is then arranged in position of use, in which it is shown in FIGS. 22 and 23, with the lower arm 107 thereof extending below the marginal or peripheral sealing flange 61 on the side wall 42 of the base 26 and with the hook-shaped latching tongue 108 thereon projecting into the latching groove 109 which is formed in the bottom surface of the marginal or peripheral sealing flange 61 on the side wall 42 of the base 26, as shown in FIGS. 22 and 23, and with the upwardly extending arm 105 thereof disposed against the outer or front surface of the upstanding rear wall 99 of the mounting member 98, as shown in FIGS. 22 and 23 of the drawings.

When the parts of the carrying handle structure 81 are so arranged, as in FIGS. 22 and 23, the generally U-shaped clamping member 103 is disposed between the supporting arms 94 of the carrying handle structure, with the generally U-shaped clamping member 103 disposed therebetween, are positioned between the bearing bosses 110 which are formed integrally with the upstanding rear wall 99 of the mounting member 98 on the upper front edge portion thereof (FIGS. 24). When the parts are so arranged, the pivot pin or rod 97 is inserted and extended through the bearing openings 111 in the bearing bosses 110 and through the bearing openings 96 in the offset camming head portions 95 of the supporting arms 94 and through the bearing opening 106 in the upwardly extending arm or head portion 105 of the U-shaped clamping member 103 (FIG. 24).

With the carrying handle structures 81 thus mounted on the mating marginal or peripheral sealing flanges 61 and 63, of the base 26 and the cover 27, respectively, of the vault 25, the thus assembled vault 25, with the remains of the deceased therein, may be carried, by means of the carrying handle structure 81, to the hearse and to the cemetery for a graveside or other cemetery service. During this carrying operation, as the assembled vault, with the remains of the deceased therein, is lifted by means of the carrying handles 93 and their supporting arms 94, the offset camming head portions 95 thereon pivot upwardly on the pivot pin or rod 97, thus causing the offset camming head portions 95 on the supporting arms 94 to engage and cam against the front surface of the upstanding rear wall 99 of the mounting member 98. This camming action tends to force the horizontal front flange or shelf 100 of the mounting member 98 downwardly and into firm engagement with the upper surface of the marginal or peripheral sealing flange 63 on the cover 27 of the assembled vault 25.

After the graveside or other sevice at the cemetery, the carrying handle structures 81 may be readily removed from the assembled vault 25 and returned to the funeral home for reuse and, if not previously done, the base and cover 27 may then be hermetically sealed, as at 76 (FIG. 10), prior to interment.

The removal of the carrying handle structures 81 from the assembled base 26 and cover 27 of the vault 25 at the cemetery is readily accomplished by releasing the manual lifting action on the carrying handles 93, thereby withdrawing the offset camming head portions 95 on the supporting arms 94 out of camming engagement with the upstanding rear wall 99 of the mounting member 98, whereupon the assembly of the mounting member 98, handle 93 and their supporting arms 94 and the offset camming head portions 95 thereon, and the U-shaped clamping member 103 and pivot pin or rod 97, may be removed from the mating marginal or peripheral sealing flanges 61 and 63 of the base 26 and cover 27, respectively, of the assembled vault 25, for return to the funeral home for reuse.

THE GENERALLY U-SHAPED RESILIENT CLAMPING AND REINFORCING MEMBERS FOR THE MATING MARGINAL SEALING FLANGES 61 AND 63 OF THE BASE 26 AND COVER 27 OF THE BURIAL VAULT 25 (FIGS. 25, 26, and 27)

After the carrying handle structures 40 and 81 have been removed from position of use, and after the cover 27 has been arranged over and hermetically sealed to the base 26 of the vault 25, a number of generally U-shaped resilient aluminum or like metal clamping and reinforcing members 116 (FIGS. 25, 26 and 27) may be slidably inserted lenghtwise over and into clamping engagement with the mating marginal flanges 61 and 63 at intervals along the side and end walls of the assembled vault 25, as illustrated in FIGS. 25 and 26, thereby enhancing the structural strength of the assembled vault and increasing its resistance to separation of the cover 27 from the base 26 of the vault 25 in the grave opening.

The U-shaped clamping and reinforcing members 116 may vary in length and a number of them as for example, three or four, may be mounted on each of the side walls and, for example, two of them, may be mounted on each of the end walls of the assembled base 26 and cover 27 of the vault 25.

Each of the generally U-shaped resilient aluminum or like metal clamping and reinforcing members 116 includes an upper resilient arm 117, a lower resilient arm 118, and an interconnecting bight portion 119.

In the use of the generally U-shaped resilient clamping and reinforcing member 116 retaining means are provided for retaining the generally U-shaped resilient clamping and reinforcing members 116 in position of use on the sealed mating marginal sealing flanges 61 and 63 of the base 26 and cover 27, respectively, of the vault 25. This retaining means is shown in FIGS. 26 and 27 of the drawings and includes a retaining plate 168 which is shown positioned over the inclined upper surface of the sealing flange 63 of the side wall 45 of the cover 27 of the vault 25 (FIG. 26). The retaining plate 168 has laterally spaced longitudinally extending latching grooves 170 formed therein on its upper surface and also has a longitudinally and upwardly extending latching tongue 171 formed therein between the latching grooves 170.

Similarly, the upper arm 117 of the resilient U-shaped clamping and reinforcing member 116 has laterally spaced longitudinally extending latching tongues 173 formed thereon, on its lower surfaces, and the arm 117 has a longitudinally extending latching groove 174 formed therein between the latching tongues 173 (FIGS. 26 and 27).

The lower arm 118 of the resilient U-shaped clamping and reinforcing members 116 has an upwardly extending latching hook portion 175 formed thereon at its inner end and the retaining plate 168 has a downwardly extending latching hook portion 176 formed thereon at its inner end (FIG. 26).

In the use of the resilient U-shaped clamping and reinforcing members 116 the retaining plate 168 is laid over the upper surface of the sealing flange 63 on the side wall 45 of the cover 27 of the vault 25 with the hook-shaped portion 176 on the retaining plate 168 engaging in the latching groove 102 which is formed on the upper surface of the sealing flange 63 of the side wall 45 of the cover 27 of the vault 25, and with a similar retaining plate 168 used on the sealing flanges 61 and 63 of the end walls of the base 26 and cover 27 of the vault 25. After the retaining plate 168 has been positioned, as shown in FIG. 26, the resilient U-shaped clamping and reinforcing member 116 is slidably inserted lengthwise over the retaining plate 168, and over the sealing flanges 61 and 63, with the latching tongues 173 on the inner surface of the upper arm 117 of the resilient U-shaped clamping and reinforcing member 116 engaging in the latching grooves 170 in the upper surface of the retaining plate 168 and with the latching tongue 171 on the upper surface of the retaining plate 168 engaging in the latching groove 174 which is formed on the inner or bottom surface of the upper arm 117 of the generally U-shaped resilient clamping and reinforcing member 116. During this assembling operation, the hook-shaped latching portion 175 on the lower arm 118 of the resilient U-shaped clamping and reinforcing member 116 engages in the latching groove 109 which is formed in the lower surface of the sealing flange 61 on the side wall 42 of the base 26 of the vault 25, and the hook-shaped latching portion 176 on the upper arm 117 of the U-shaped clamping and reinforcing member 116 engages in the groove 102 which is formed in the sealing flange 63 on the side wall 45 of the cover 27 of the vault.

When the resilient U-shaped clamping and reinforcing member 116 and associated retaining plates 168 are thus mounted in position of use on the assembled base 26 and cover 27 of the vault 25 they substantially enhance the structural strength of the hermetically sealed vault 25 in the grave opening and significantly increase the resistance of the base 26 and cover 27 to separation in the grave opening.

It will thus be seen that the present invention provides a new and improved combination burial vault and casket and a new and improved funeral and burial vault method or system employing the same, and that the invention thus has the desirable advantages and characteristics and accomplishes its intended objects including these hereinbefore pointed out and others which are inherent in the invention.

I claim:

1. A combination burial vault and casket comprising (a) a burial vault including (1) a base adapted to be arranged over and mounted on a supporting member at a funeral home during visitation and the funeral service at the funeral home including
a. upright side walls and end walls having
1. marginal upper edge portions;
(b) a surround or false casket arranged over and assembled with the said base of the said burial vault at the funeral home during visitation and the funeral service at the funeral home and cooperating with the said base of the burial vault at the funeral home to provide a casket in which the remains of the deceased are rested during visitation and the funeral service at the funeral home;
(c) the said surround or false casket including
(1) a generally rectangular-shaped open frame which is substantially dimensionally coextensive with the said marginal upper edge portions of the said upright side and end walls of the said base of the said vault and including
a. a front side wall;
b. a rear side wall; and
c. end walls; and
(2) a top or closure member hingedly connected to the said rear side wall of the said generally rectangular-shaped open frame of the said surround or false casket;
(d) the said vault including a cover adapted to be arranged over the said base of the vault and to be hermetically sealed thereto with the remains of the deceased enclosed within the said burial vault after removal of the said surround or false casket from the said base of the said vault, and including
(1) side walls and end walls having
a. lower marginal edge portions;
(e) the said vault including cooperating sealing means on the said upper marginal edge portions of the said side walls and end walls of the said base of the said vault and on the said lower marginal edge portions of the said side walls and end walls of the said cover of the said vault for hermetically sealing the said base and the said cover together in assembled position with the remains of the deceased enclosed therein prior to interment.

2. A combination burial vault and casket as defined in claim 1 in which the said cooperating sealing means includes
(a) mating marginal sealing flanges formed integrally with and projecting laterally outwardly from the said upper marginal edge portions of the said side walls and end walls of the said base of the said vault and from the said lower marginal edge portions of the said cover of the said vault; and in which
(b) the said mating marginal sealing flanges are arranged in mating relationship when the said base and cover of the said vault are assembled together.

3. A combination burial vault and casket as defined in claim 2 in which
(a) the said mating marginal sealing flanges have
(1) mating tongue and groove sealing means formed therein for hermetically sealing the said base and the said cover together in assembled relationship prior to interment of the said vault

4. A combination burial vault and casket as defined in claim 1 in which the said top or closure member of the said surround or false casket includes
(a) a foot section; and
(b) a head section; and in which
(c) both of the said foot section and the said head section of the said top or closure member are hingedly mounted on the said rear wall of the said generally rectangular-shaped open frame of the said surround or false casket but are separately hingedly movable thereon into and from open and closed position.

5. A combination burial vault and casket as defined in claim 1 in which the said base of the said vault and the said surround or false casket have
(a) interior surfaces; and in which
(b) the said interior surfaces of the said base of the said vault and of the said surround or false casket have
(1) decorative casket upholstery material arranged thereon to simulate the appearance of a conventional burial casket.

6. A combination burial vault and casket as defined in claim 2 which includes
(a) carrying handle structures mounted on the said side walls of the said generally rectangular-shaped open frame of the said surround or false casket for carrying the assembled base and surround or false casket to the cemetery for a graveside or other cemetery service at the close of visitation and the funeral home service at the funeral home; and
(b) mounting means for pivotally mounting the said carrying handle structures on the said side walls of the said generally rectangular-shaped open frame of the said surround or false casket.

7. A combination burial vault and casket as defined in claim 6 in which each of the said carrying handle structure includes
(a) a handle member;
(b) handle supporting means for supporting the said handle member;
(c) means for pivotally mounting the said handle-supporting means on the said mounting means; and
(d) latching means pivotally connected to and under the control of the said handle-supporting arm means for latching engagement with the said marginal sealing flanges on the said side walls of the said base of the said vault.

8. A combination burial vault and casket as defined in claim 7 which includes
(a) latching means formed in the said marginal sealing flanges of the said side walls of the said base of the said vault and coacting with the said latching means which are pivotally connected to and under the control of the said handle-supporting means for latchingly engaging the said generally rectangular-shaped open frame of the said surround or false casket with the said marginal sealing flanges on the said side walls of the said base of the said vault.

9. A combination burial vault and casket as defined in claim 2 which includes means for removably mounting the said carrying handle structures on the said mating marginal sealing flanges of the said side walls of the said base and the said mating marginal sealing flanges on the said side walls of the said cover when the said base and the said cover are in assembled position for carrying the assembled vault, with the remains of the decreased therein, to the cemetery for a graveside or other cemetery service after the close of visitation and other funeral services at the funeral home.

10. A combination burial vault and casket as defined in claim 9 in which
(a) resilient generally U-shaped clamping and reinforcing members are inserted over and resiliently engage the said mating marginal sealing flanges of the said base and the cover of the said vault after the said surround or false casket of the said carrying handle structures mounted thereon have been removed from the said base of the vault and the cover of the said vault has been placed over the said base thereof and the said mating marginal sealing flanges of the said base and cover of the said burial vault have been hermetically sealed together prior to interment of the vault.

11. A combination burial vault and casket as defined in claim 10 which includes (a) retaining means for retaining the said generally U-shaped clamping and reinforcing members in position of use on the said mating marginal sealing flanges of the said base and cover of the said vault.

12. A combination burial vault and casket as defined in claim 11 in which the said mating marginal flanges of the said base and cover have formed therein (a) longitudinally extending latching grooves; and in which each of the said resilient generally U-shaped clamping and reinforcing members has formed thereon (1) latching tongues engaging in the said longitudinally extending latching grooves in the said mating marginal flanges of the said base and cover of the said vault.

13. A combination burial vault and casket as defined in claim 11 in which each of (a) the said generally U-shaped clamping and reinforcing members includes (1) an upper arm;

(2) a lower arm; and (3) a bight portion interconnecting the said upper and lower arms; and in which (b) the said retaining means includes (1) a retaining plate member arranged over and mounted on the said marginal sealing flange of the said cover of the said vault and between the said upper arm of the said generally U-shaped clamping and reinforcing member and the said marginal sealing flange of the said cover of the said vault.

14. A combination burial vault and casket as defined in claim 13 in which (a) the said upper arm of the said generally clamping and reinforcing member and the said retaining plate member have formed therein (1) coacting tongue and groove latching means for latching the said upper arm of the said generally U-shaped clamping and reinforcing member and the said retaining plate member together in assembled relationship.

15. A burial vault as defined in claim 1 in which (a) the said base and the said cover of the said vault are formed of and molded from plastic resinous molding material.

16. A funeral and burial method or system which employs a burial vault formed of molded plastic resinous material and which includes a base including side walls and end walls, and having an open top and a cover or closure member for the said base, and a surround or false casket which includes a generally rectangular-shaped open frame which is substantially dimensionally coextensive with the said side walls and end walls of the said base of the vault and has a top or closure member hingedly mounted on and connected to the said generally rectangular shaped open frame of the said surround or false casket, and the said generally rectangular-shaped open frame of the said surround or false casket having carrying handle structures mounted on the side walls thereof, the said funeral and burial vault method or system comprising the steps of:

(a) mounting the said base of the said burial vault on a supporting member in a funeral home or like place;

(b) assembling the said surround or false casket and its generally rectangular-shaped open frame and the carrying handle structures mounted thereon over the said open top of the said base of the vault so that the said surround or false casket cooperates with the said base of the said vault to provide a display casket in which the remains of the deceased are rested for viewing during visitation and the funeral service at the funeral home, or like place;

(c) removing the said surround or false casket and the said carrying handle structures attached thereto from the said open top of the said base of the said burial vault prior to interment;

(d) arranging the said cover of the said burial vault over the said open top of the said base of the said burial vault; and (e) hermetically sealing the said cover of the said burial vault to the said base thereof prior to interment.

17. A funeral and burial method or system as defined in claim 16 in which the said base of the said burial vault and the said surround or false casket includes a generally rectangular-shaped open frame including side walls and end walls having interior surfaces and in which the said surround or false casket includes a top or closure member which is hingedly connected to one of the said side walls of the said base and has an interior surface, and in which the said funeral and burial vault method or system includes the step of (a) providing decorative casket upholstery material on the said interior surfaces of the said base and the interior surfaces of the said side walls and end walls of the said generally rectangular-shaped open frame of the said surround or false casket and on the said interior surface of the said top or closure member of the said surround or false casket.

18. A funeral and burial method or system as defined in claim 16 which includes the steps of (a) closing the said top or cover of the said surround or false casket over the said generally rectangular-shaped open frame thereof at the close of the visitation and the funeral service at the funeral home and assembling the said surround or false casket over the said base of the said vault to provide an assembly for carrying the remains of the deceased to the cemetery for a graveside or other cemetery service;

(b) removing the said surround or false casket and the said carrying handle structures mounted thereon from the said base of the vault at the cemetery;

(c) arranging the said cover of the said vault over the said base thereof with the remains of the deceased arranged therein;

(d) hermetically sealing the said base and the said cover of the vault together at the cemetery prior to interment of the vault; and (e) returning the said surround and the said carrying handle structures mounted thereon to the funeral home for reuse.

19. A funeral and burial method or system as defined in claim 17 in which the said base and the said cover of the said vault include side and end walls having upper and lower marginal edge portions, respectively, and in which the said side walls and end walls of the said base and cover of the said vault have outwardly projecting mating marginal sealing flanges formed therein and which funeral and burial method or system includes the steps of (a) removably mounting carrying handle structures on the said mating marginal sealing flanges of the said base and cover of the said vault after visitation and the funeral service at the funeral home for carrying the said burial vault, with the remains of the deceased therein, to the cemetery for a graveside or other cemetery service;

(b) removing the said carrying handle structures from the said mating marginal sealing flanges of the said base and cover of the said burial vault prior to interment and (c) returning the said carrying handle structures to the funeral home for reuse.

20. A funeral and burial method or system as defined in claim 19 which includes the step of (a) hermetically sealing the said mating marginal sealing flanges of the said base and cover of the said vault together at the funeral home after the close of the visitation and the funeral services at the funeral home.

21. A funeral and burial method or system as defined in claim 20 which includes the step of (a) hermetically sealing the said mating marginal sealing flanges of the said base and cover of the said vault together at the cemetery prior to interment of the vault.

22. A funeral and burial vault method or system as defined in claim 21 which includes the step of (a) inserting resilient generally U-shaped metal clamping and reinforcing members over the said mating marginal sealing flanges of the assembled and sealed vault at the cemetery prior to interment of the said vault.

23. A combination burial vault and carrying handle structures therefor comprising:

(a) a burial vault including a base having
  (1) a bottom wall;
  (2) upright side walls and end walls having marginal upper edge portions;

(b) a cover including
  (1) a top wall;
  (2) side walls and end walls having lower marginal edge portions;

(c) said upper marginal edge portions of the said side walls and end walls of the said base and the said lower marginal edge portions of the said side walls and end walls of the said cover having formed integrally therewith and projecting laterally outwardly therefrom
  (1) mating marginal sealing flanges; and (d) carrying handle structures removably mounted on the said mating marginal sealing flanges of the said base and the said cover for carrying the assembled base and the said cover of the said vault from the funeral home to the cemetery for a graveside or other cemetery service; and (e) mounting means for removably mounting the said carrying handle structures on the said mating marginal sealing flanges of the said base and said cover of the said vault prior to interment.

24. A combination burial vault and carrying handle structure therefor as defined in claim 23 in which each of the said carrying handle structures includes (a) a handle member;

(b) handle supporting means; and (c) means for pivotally mounting the said handle supporting means on the said mounting means.

25. A combination burial vault and carrying handle structure as defined in claim 24 in which (a) each of the said marginal sealing flanges on the said upper marginal edge portions of the said side walls of the said base of the said vault includes
  (1) a lower surface having formed therein
    a. a longitudinally extending latching groove; and in which each of the said carrying handle structures includes (b) latching means under the control of the said handle supporting means including
  (1) a latching member urged by pivotal movement of the said handle supporting means into latching engagement with the said longitudinally extending latching groove in the said lower surface of the said marginal sealing flange on the said side walls of the said base for latchingly mounting the said handle structure on the said marginal sealing flanges of the said side walls of the said base of the said vault.

26. A burial vault comprising (a) a bottom wall;

(b) upright side walls and end walls having marginal upper edge portions;

(c) a cover including
  (1) a top wall;
  (2) side walls and end walls having lower marginal edge portions;

(d) said upper marginal edge portions of the said side walls and end walls of the base and the said lower marginal edge portions of the said side walls and end walls of the said cover having formed integrally therewith and projecting laterally outwardly therefrom
  (1) mating marginal sealing flanges; and (e) generally U-shaped resilient clamping and reinforcing members mounted on the said mating marginal sealing flanges of the said base and cover of the said vault to enchance the structural strength thereof and resistance to the separation of the said cover and base of the said vault in the grave opening.

27. A burial vault as defined in claim 26 which includes (a) retaining means cooperating with the said generally U-shaped resilient clamping and reinforcing members for retaining the said generally U-shaped clamping and reinforcing members in position of use on the said mating marginal sealing flanges of the said vault.

28. A burial vault as defined in claim 26 in which each of the said generally U-shaped clamping and reinforcing members includes (a) an upper arm and a lower arm spaced from each other and a bight portion interconnecting the said upper and lower arms of the said generally U-shaped clamping and reinforcing member; and in which (b) the said retaining means includes a retaining plate member arranged between the said upper arm of the said generally U-shaped clamping and reinforcing member and the said marginal sealing flange on the said cover of the said vault.

29. A burial vault as defined in claim 28 in which the said marginal sealing flange on the said side walls of the said base includes (a) a lower surface; and in which each of the said marginal sealing flanges on the said side walls of the said base has (b) a longitudinally extending latching groove formed therein in its said lower surface; and in which (c) the said lower arm of the said generally U-shaped clamping and reinforcing member has (1) a latching tongue formed thereon which is latchingly engageable in the said longitudinally extending latching groove in the said lower surface of the said marginal sealing flange in the said side wall of the said base of the said vault for latching the said generally U-shaped clamping and reinforcing member in position of use on and to the said mating marginal sealing flanges of the said base and the said cover of the said vault.

* * * * *